US008523696B2

(12) United States Patent
Kamino et al.

(10) Patent No.: US 8,523,696 B2
(45) Date of Patent: Sep. 3, 2013

(54) GOLF SWING ANALYSIS METHOD USING ATTACHABLE ACCELERATION SENSORS

(75) Inventors: Kazuya Kamino, Kobe (JP); Keiji Moriyama, Kobe (JP); Yasushi Chida, Hyogo (JP)

(73) Assignees: SRI Sports Limited, Kobe (JP); Bycen Co., Ltd., Kobe (JP)

( * ) Notice: Subject to any disclaimer, the term of this patent is extended or adjusted under 35 U.S.C. 154(b) by 145 days.

(21) Appl. No.: 12/759,831

(22) Filed: Apr. 14, 2010

(65) Prior Publication Data

US 2010/0323805 A1 Dec. 23, 2010

(30) Foreign Application Priority Data

Jun. 17, 2009 (JP) ..... 2009-143944

(51) Int. Cl.
*A63B 69/36* (2006.01)

(52) U.S. Cl.
USPC ..... 473/131; 702/152

(58) Field of Classification Search
USPC ..... 463/30; 473/131, 202, 212–216; 702/152
See application file for complete search history.

(56) References Cited

U.S. PATENT DOCUMENTS

| | | | | |
|---|---|---|---|---|
| 3,717,857 | A * | 2/1973 | Evans | 340/870.13 |
| 5,233,544 | A * | 8/1993 | Kobayashi | 702/141 |
| 5,511,789 | A * | 4/1996 | Nakamura | 473/202 |
| 5,638,300 | A * | 6/1997 | Johnson | 702/153 |
| 5,907,819 | A * | 5/1999 | Johnson | 702/152 |
| 5,984,810 | A * | 11/1999 | Frye et al. | 473/455 |
| 6,567,536 | B2 * | 5/2003 | McNitt et al. | 382/107 |
| 6,636,826 | B1 * | 10/2003 | Abe et al. | 702/151 |
| 7,074,168 | B1 * | 7/2006 | Farnes et al. | 482/148 |
| 7,101,287 | B1 * | 9/2006 | Wagner | 473/207 |
| 7,602,301 | B1 * | 10/2009 | Stirling et al. | 340/573.1 |
| 2006/0111197 | A1 * | 5/2006 | Yamamoto et al. | 473/151 |
| 2006/0166737 | A1 * | 7/2006 | Bentley | 463/30 |
| 2007/0135225 | A1 * | 6/2007 | Nieminen et al. | 473/212 |
| 2007/0270214 | A1 | 11/2007 | Bentley | |
| 2008/0115582 | A1 | 5/2008 | Sato et al. | |
| 2009/0270204 | A1 * | 10/2009 | Saegusa et al. | 473/409 |

FOREIGN PATENT DOCUMENTS

| | | |
|---|---|---|
| JP | 63-68187 A | 3/1988 |
| JP | 7-204306 A | 8/1995 |
| JP | 8-224330 A | 9/1996 |

(Continued)

OTHER PUBLICATIONS

Kistler Instruments Ltd., Kistler Instruments Product News, Sep. 2004, http://www.sensorland.com/PRPages/Kistler028.html.*

*Primary Examiner* — Dmitry Suhol
*Assistant Examiner* — Jason Yen
(74) *Attorney, Agent, or Firm* — Birch, Stewart, Kolasch & Birch, LLP

(57) ABSTRACT

A swing analysis method of the present invention includes steps of: preparing a radio type acceleration measuring device 4 capable of measuring respective accelerations in three axis directions; mounting the acceleration measuring device 4 to a golf player's body t1; receiving measured data from the acceleration measuring device 4 during a swing through radio communication; and analyzing a golf swing based on the acceleration data. Preferably, the acceleration measuring device is attached to each of two or more portions of the tester t1. Preferably, an attached position of the acceleration measuring device is any part selected from the group consisting of a head, a neck, a shoulder, a back, a waist and a wrist. Preferably, a weight of the acceleration measuring device is equal to or more than 10 g.

7 Claims, 40 Drawing Sheets

(56) References Cited

FOREIGN PATENT DOCUMENTS

| | | | | |
|---|---|---|---|---|
| JP | 10-43349 | A | | 2/1998 |
| JP | 11-216217 | A | | 8/1999 |
| JP | 2001-614 | A | | 1/2001 |
| JP | 2001-000614 | A | | 1/2001 |
| JP | 2001000614 | A | * | 1/2001 |
| JP | 2002-537957 | A | | 11/2002 |
| JP | 2003-117043 | A | | 4/2003 |
| JP | 2005-74010 | A | | 3/2005 |
| JP | 2005-110850 | A | | 4/2005 |
| JP | 2005-152321 | A | | 6/2005 |
| JP | 2005-198818 | A | | 7/2005 |
| JP | 2006-70111 | A | | 3/2006 |
| JP | 2006-141298 | A | | 6/2006 |
| JP | 2006-230466 | A | | 9/2006 |
| JP | 2008-528195 | A | | 7/2008 |
| WO | WO 00/53272 | A2 | | 9/2000 |

* cited by examiner

GOLF SWING ANALYSIS METHOD USING ATTACHABLE ACCELERATION SENSORS

This application claims priority on Patent Application No. 2009-143944 filed in JAPAN on Jun. 17, 2009. The entire contents of this Japanese Patent Application are hereby incorporated by reference.

BACKGROUND OF THE INVENTION

1. Field of the Invention

The present invention relates to a golf swing analysis method.

2. Description of the Related Art

A golf swing varies for every golf player. A golf club affects the swing. The matching between the swing and the golf club is important. The matching between the swing and a golf ball is important.

The analysis of the golf swing is indispensable for developing the golf club, the golf ball, or the like. The result of the swing analysis can be the selection standard of the golf club and golf ball. The swing analysis is useful for the sales promotion of the golf club, golf ball, or the like.

Conventionally, swing analysis based on sensibility of a golf player has been performed. Quantitative evaluation has not been enabled in this swing analysis. Qualitative evaluation based on the sensibility of the golf player has ambiguity. The qualitative evaluation is apt to lack accuracy.

Japanese Patent Application Laid-Open Publication No. 3-126477 (U.S. Pat. No. 5,233,544) discloses a swing analysis device having a plurality of acceleration sensors attached to a golf club. Japanese Patent Application Laid-Open Publication No. 10-43349 discloses a swing diagnostic device having an acceleration sensor attached to the front side from a wrist (a back of a hand or the like). Japanese Patent Application Laid-Open Publication No. 2005-74010 discloses a method for classifying a swing using an acceleration value of an acceleration sensor attached to a golf club head, the acceleration sensor detecting acceleration in the axis direction of a shaft. Japanese Patent Application Laid-Open Publication No. 2005-152321 discloses a system for detecting the position and posture of a golf club. In this system, three-dimensional acceleration sensors are attached to a head and a shaft of a golf club. Japanese Patent Application Laid-Open Publication No. 2008-125722 (US No. 2008/115582) discloses a method for evaluating shot feeling, the method measuring the vibration of a shaft in the circumferencial direction of the shaft using a three-axis accelerometer attached to the shaft.

SUMMARY OF THE INVENTION

A swing motion is complicated. The swing analysis is desirably performed from various viewpoints. There is a need for a method capable of analyzing the swing from many angles. There is a need for a technique of quantitive swing analysis in light of analysis accuracy.

In the present invention, the swing analysis is performed based on a viewpoint different from that of the conventional technique. It is an object of the present invention to provide a swing analysis method which enables diversified swing analysis and can contribute to enhancement in the analysis accuracy.

A swing analysis method according to the present invention includes steps of:

preparing a radio type acceleration measuring device capable of measuring respective accelerations in three axis directions of an x-axis direction, a y-axis direction, and a z-axis direction;

mounting the acceleration measuring device to a golf player's body;

receiving measured data from the acceleration measuring device during a swing through radio communication; and analyzing a golf swing based on the measured data.

Preferably, the acceleration measuring device is attached to each of two or more portions of the body.

Preferably, an attached position of the acceleration measuring device is a head, a neck, a shoulder, a back, a waist, or a wrist.

Preferably, a weight of the acceleration measuring device is equal to or less than 10 g.

Preferably, in the analysis method, a trigger signal is generated at a time point during the swing, and the acceleration data is associated with a swing motion in time series based on the trigger signal.

Preferably, the time point at which the trigger signal is generated is a top-of-swing or an impact.

Preferably, a direction connecting an impact point to a target point and being parallel to a ground is an X-axis direction; a vertical direction is a Y-axis direction; a direction being perpendicular to the X-axis direction and the Y-axis direction is a Z-axis direction; and the acceleration data has a component of the Z-axis direction.

Preferably, the acceleration data is time-series data of acceleration Ax in the x-axis direction, acceleration Ay in the y-axis direction or acceleration Az in the z-axis direction. Preferably, a maximum value and a minimum value in a specific section during the swing are obtained for a value calculated from the acceleration Ax, the acceleration Ay, the acceleration Az, or at least one of the accelerations; and a difference between the maximum value and the minimum value is taken as an indication of swing analysis.

Preferably, the acceleration data is time-series data of acceleration Ax in the x-axis direction, acceleration Ay in the y-axis direction, or acceleration Az in the z-axis direction. Preferably, a maximum value and a minimum value in a specific section during the swing are obtained for a value calculated from the acceleration Ax, the acceleration Ay, the acceleration Az, or at least one of the accelerations; and a time difference Td1 between a time of the maximum value and a time of the minimum value is taken as an indication of swing analysis.

Preferably, the same golf player swings the same golf club plural times, and a plurality of graph lines are obtained based on data of the plurality of swings. Preferably, an area s1 surrounded by the plurality of graph lines is taken as an indication of swing analysis.

Preferably, repeatability of a swing is determined based on any of the swing analysis methods.

In a golf club selection method of the present invention, a golf club suitable for a golf player who performs swings is selected based on any of the swing analysis methods.

The swing analysis method according to the present invention enables the swing analysis from various viewpoints. The swing analysis method enables the quantitive swing analysis.

DESCRIPTION OF THE PREFERRED EMBODIMENTS

Hereinafter, the present invention will be described in detail according to the preferred embodiments with appropriate references to the accompanying drawings.

Figure 1:
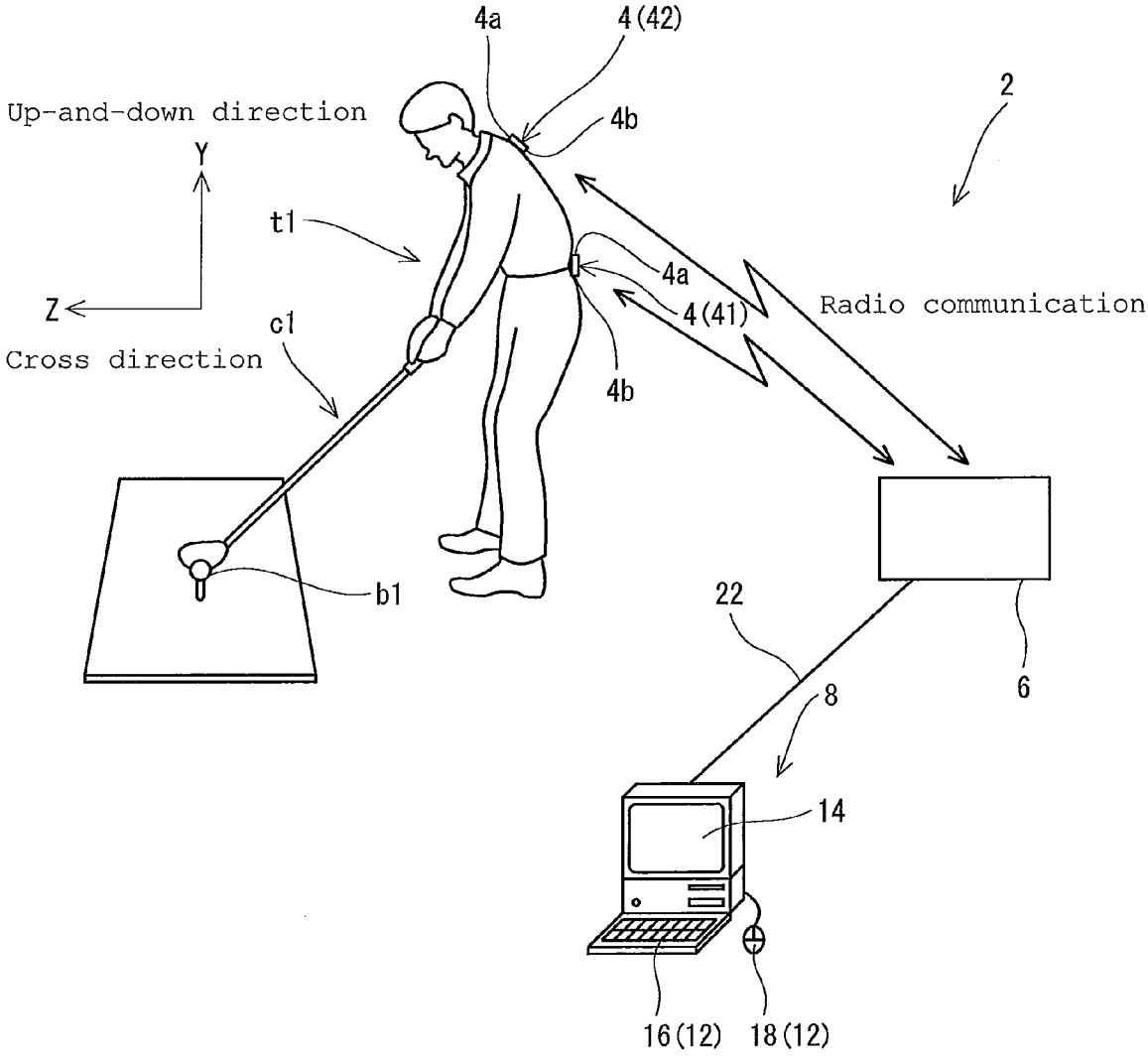
FIG. 1 describes an example of a swing measurement method according to an analysis method of the present invention.

FIG. 1 shows one embodiment of the present invention. A swing analysis system 2 is used in this embodiment.

The swing analysis system 2 has an acceleration measuring device 4, a radio receiver 6, and a data analysis device 8. Two acceleration measuring devices 4 are used in the embodiment of FIG. 1.

The acceleration measuring device 4 is a radio type. The acceleration measuring device 4 can transmit measured data by radio. This radio communication will be described in detail later. As the radio communication, for example, the standard and technique of Bluetooth can be suitably used.

The acceleration measuring device 4 has an acceleration sensor incorporated therein, the acceleration sensor capable of measuring respective accelerations in three axis directions (an x-axis, a y-axis, and a z-axis). Furthermore, the acceleration measuring device 4 has an A/D converter, a CPU, a radio interface, a radio antenna, and a power supply. As the power supply, a battery is used. As the battery, for example, small batteries such as a lithium ion battery are suitably used. A so-called button-shaped battery can be suitably used. The battery may be chargeable. The acceleration measuring device 4 may have a charge circuit for charging the battery.

Although not shown in the Figure, the radio receiver 6 has a radio antenna, a radio interface, a CPU, and a network interface.

As the data analysis device 8, for example, a computer is used. The data analysis device 8 has an input part 12 and a display part 14. Although not shown in the Figure, the data analysis device 8 has a hard disk, a memory, a CPU and a network interface. The input part 12 has a keyboard 16 and a mouse 18.

FIG. 1 shows a tester t1, a golf club c1, and a golf ball b1 in addition to the swing analysis system 2. The tester t1 drawn in FIG. 1 is in an address state. The tester t1 is a right-handed person.

The acceleration sensor detects respective accelerations in an x-axis direction, a y-axis direction, and a z-axis direction. This acceleration is obtained as an analog signal. This analog signal is converted into a digital signal by the A/D converter. The output from the A/D converter is transmitted to, for example, the CPU where computing processes such as primary filtering are executed.

Thus, the data processed in the acceleration measuring device 4 is transmitted from the radio antenna through the radio interface.

The data transmitted from the radio antenna of the acceleration measuring device 4 is received by the radio interface through the radio antenna of the radio receiver 6 side. This received data is computed by, for example, the CPU. The computed data is sent to the data analysis device 8 through, for example, a network 22.

The data sent to the data analysis device 8 is recorded in memory resources such as a hard disk. The hard disk stores program and data or the like required for data processing or the like. This program makes the CPU execute necessary data processing. The CPU can execute various computing processes. Examples of the computing processes will be described later. The computing result is output by the display part 14 or a printer or the like which is not shown.

Figure 2:
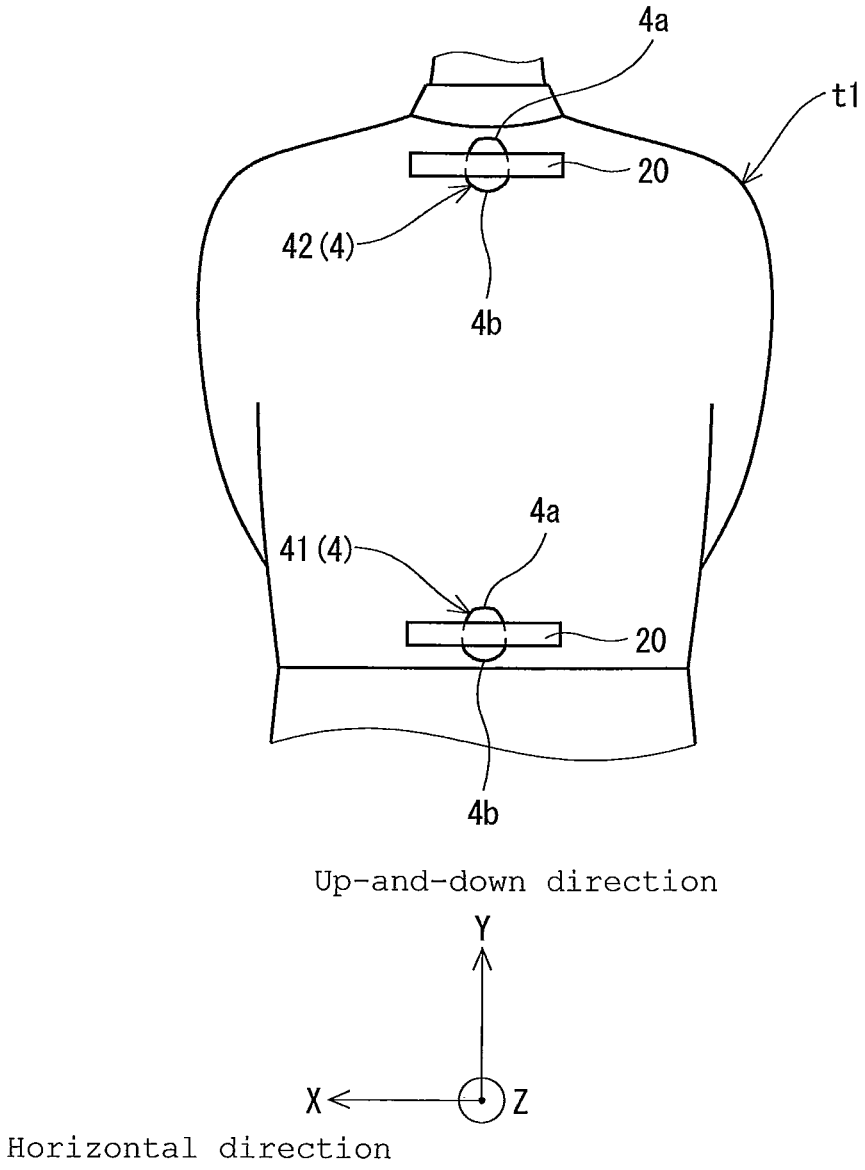
FIG. 2 shows a tester of FIG. 1 viewed from the back side.

FIG. 2 shows the tester t1 of the address state viewed from the back side. The two acceleration measuring devices 4 are an acceleration measuring device 41 attached to a back side of a waist of the tester t1, and an acceleration measuring device 42 attached to the vicinity of a root of a neck (hereinafter, merely also referred to as "neck"). In the embodiment of FIG. 2, the acceleration measuring devices 4 are attached by adhesive tapes 20. A method for attaching the acceleration measuring device 4 is not limited. The acceleration measuring device 4, which is compact and light-weight and which has no wiring, is easily attached to the tester t1.

Figure 3A:
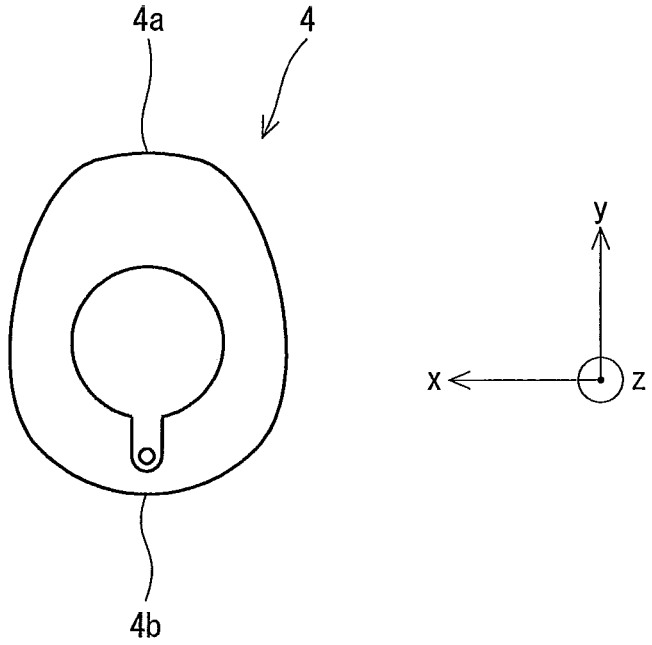
FIG. 3A is a front view of an acceleration measuring device.
Figure 3B:
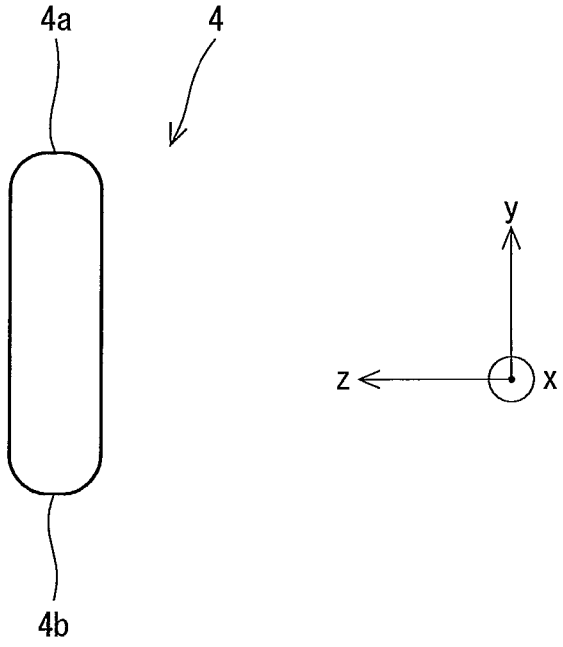
FIG. 3B is a side view of the acceleration measuring device.

FIG. 3 is an enlarged view of the acceleration measuring device 4. FIG. 3(*a*) is a front view of the acceleration measuring device 4. FIG. 3(*b*) is a side view of the acceleration measuring device 4. The acceleration measuring device 4 has an upper end 4*a* and a lower end 4*b*. The acceleration measuring device 4 presents a flat shape as a whole. The acceleration measuring device 4 having this shape is easily attached to a human body.

Since the acceleration measuring device 4 is compact and light-weight, the acceleration measuring device 4 does not hinder a swing. Since the acceleration measuring device 4 has no wiring, the acceleration measuring device 4 does not hinder the swing. In this embodiment, the tester t1 can perform a natural swing without being hindered by a measuring machine. The tester t1 can perform an original swing. Since the natural swing is attained by the acceleration measuring device 4, the measurement accuracy of the swing is enhanced.

The acceleration sensor incorporated in the acceleration measuring device 4 is a triaxial acceleration sensor, and can measure respective accelerations in the three axis directions.

[Measurement Directions of Acceleration Sensor: x-Axis, y-Axis, z-Axis]

In this application, the three directions of the acceleration sensor are described as an x-axis direction, a y-axis direction, and a z-axis direction. The x-axis, they-axis, and the z-axis are three-dimensional orthogonal axes. That is, the x-axis direction is perpendicular to the y-axis direction, and the z-axis direction is perpendicular to the x-axis direction and the y-axis direction.

FIG. 3 shows three measurable directions of the acceleration measuring device 4, that is, the x-axis direction, the y-axis direction, and the z-axis direction. In the acceleration measuring device 4 of this embodiment, the y-axis direction is the longitudinal direction of the acceleration measuring device 4. That is, the y-axis direction is a direction connecting the upper end 4*a* to the lower end 4*b*. The x-axis direction is a direction connecting the right side surface of the acceleration measuring device 4 to the left side surface thereof. The z-axis direction is perpendicular to the x-axis direction, and is perpendicular to the y-axis direction.

In this application, apart from the x-axis, the y-axis, and the z-axis, an X-axis, a Y-axis, and a Z-axis using "X", "Y", and "Z" of capital letters are defined. The X-axis, the Y-axis and the Z-axis (capital letters) show three dimensional orthogonal axes in a space. On the other hand, in the x-axis, y-axis and z-axis as the measurement direction of the acceleration sensor, "x", "y" and "z" of small letters are used. Thus, in this application, the axes are distinguished by the capital letters and the small letters. The details of the X-axis, Y-axis and Z-axis (capital letters) are as follows.

[Three-Dimensional Orthogonal Axes in Space: X-Axis, Y-Axis and Z-Axis]

In this application, an X-axis direction, a Y-axis direction, and a Z-axis direction are defined as follows.

(1) X-Axis Direction

The X-axis direction is set to a direction connecting an impact point to a target point and being parallel to a ground. This X-axis direction is shown in FIG. 2. This X-axis direction is also referred to as a horizontal direction in this application.

(2) Y-Axis Direction

The Y-axis direction is set to a vertical direction. In other words, the Y-axis direction is set to a direction perpendicular to a level surface. This Y-axis direction is shown in FIGS. 1 and 2. This Y-axis direction is also referred to as an up-and-down direction in this application.

(3) Z-Axis Direction

The Z-axis direction is set to a direction perpendicular to the X-axis direction and the Y-axis direction. The Z-axis direction is shown in FIGS. 1 and 2. This Z-axis direction is also referred to as a cross direction in this application.

The attached posture of the acceleration measuring device 4 is not limited. The acceleration measuring device 4 is preferably attached so that the x-axis direction, the y-axis direction, and/or the z-axis direction agree with a direction intended to measure as much as possible. The posture of the acceleration measuring device 4 when being attached can be suitably determined according to the object of swing analysis.

In this embodiment, in the tester t1 of the address state, the acceleration measuring device 4 is mounted to the tester t1 so that the x-axis direction of the acceleration measuring device 4 is as close as possible to the X-axis direction (see FIG. 2).

In this embodiment, in the tester t1 of the address state, the acceleration measuring device 4 is mounted to the tester t1 so that the y-axis direction of the acceleration measuring device 4 is as close as possible to the Y-axis direction (up-and-down direction) (see FIG. 2).

In this embodiment, in the tester t1 of the address state, the acceleration measuring device 4 is mounted to the tester t1 so that the z-axis direction of the acceleration measuring device 4 is as close as possible to the Z-axis direction (cross direction) (see FIG. 2).

In the embodiment, in the tester t1 of the address state, the x-axis direction, among the x-axis direction, the y-axis direction, and the z-axis direction, is closest to the horizontal direction (X-axis direction). The tendency of the acceleration in the horizontal direction (X-axis direction) can be determined by the acceleration in the x-axis direction.

In the embodiment, in the tester t1 of the address state, the y-axis direction, among the x-axis direction, the y-axis direction, and the z-axis direction, is closest to the up-and-down direction (Y-axis direction). The tendency of the acceleration in the up-and-down direction (Y-axis direction) is determined by the acceleration in the y-axis direction.

In the embodiment, in the tester t1 of the address state, the z-axis direction, among the x-axis direction, the y-axis direction, and the z-axis direction, is closest to the cross direction (Z-axis direction). The tendency of the acceleration in the cross direction (Z-axis direction) is determined by the acceleration in the z-axis direction.

In this application, a predetermined time during the swing is also referred to as "a section". A measured time is also referred to as a measuring section. The measuring section may be the whole swing or a part of the swing.

Figure 4:
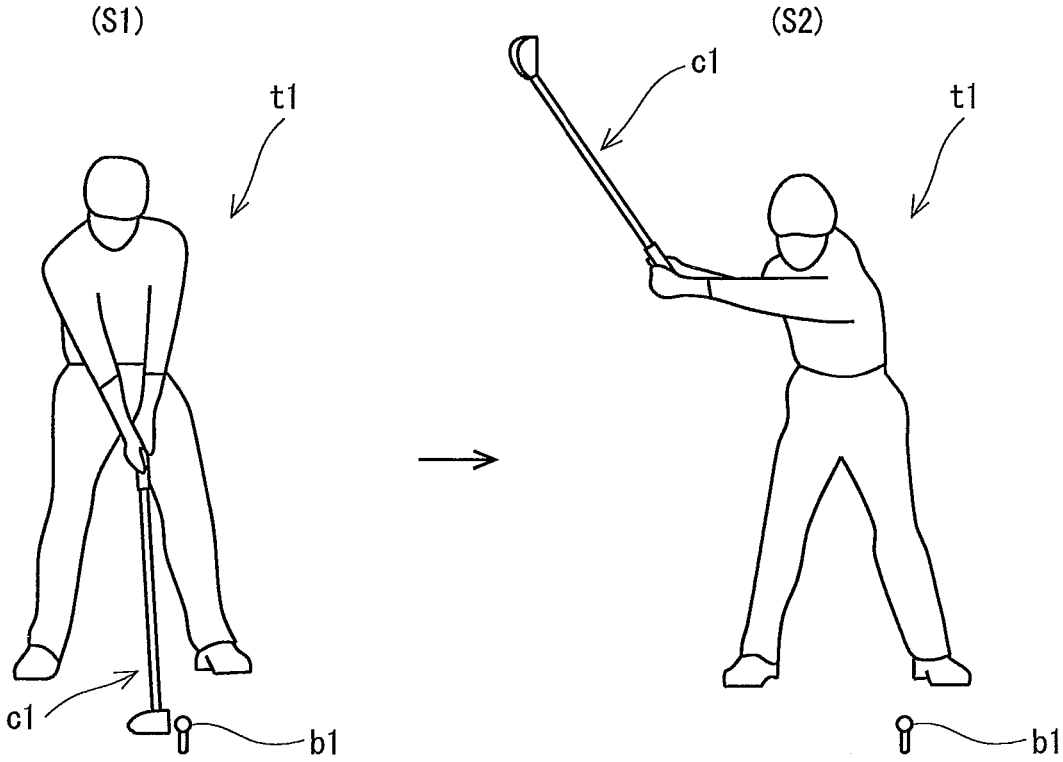
FIG. 4 shows the condition of a swing (an address and a take-back are shown)
Figure 5:
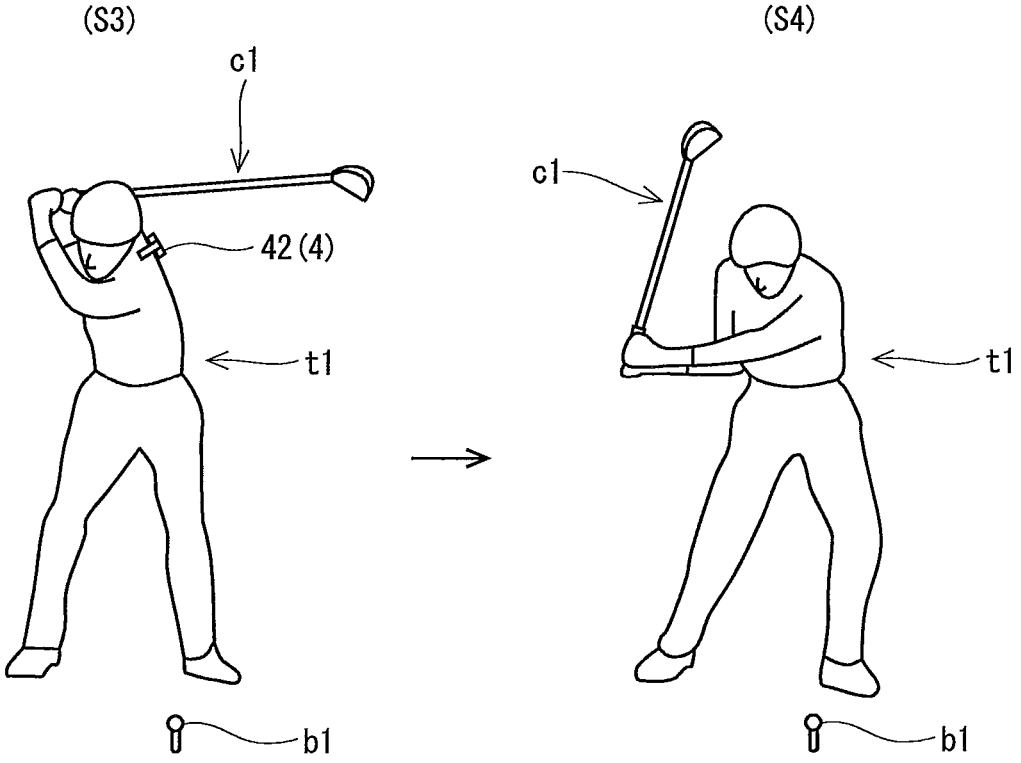
FIG. 5 shows the condition of a swing (a top-of-swing and a downswing are shown)
Figure 6:
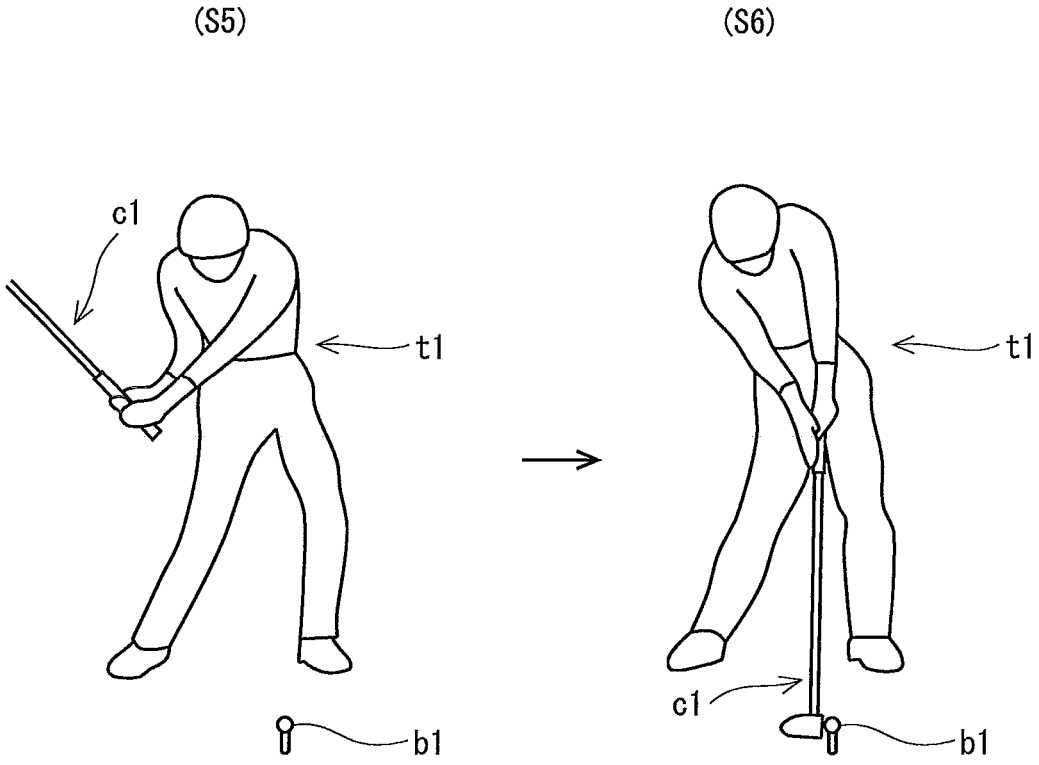
FIG. 6 shows the condition of a swing (a downswing and an impact are shown)
Figure 7:
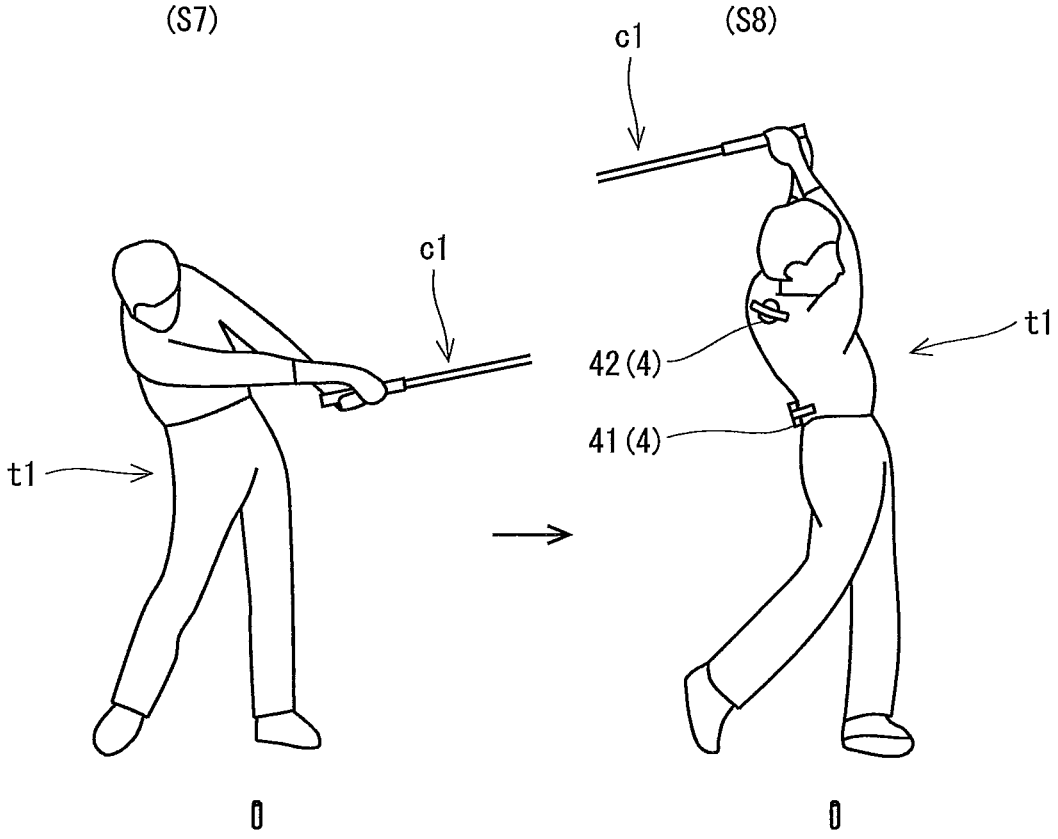
FIG. 7 shows the condition of a swing (a follow-through and a finish are shown)

The start of the swing is an address. The end of the swing is referred to as a finish. FIGS. 4 to 7 show the conditions of the tester t1 swinging. FIGS. 4 to 7 show the tester t1 viewed from the front (front side). The swing advances in order of (S1), (S2), (S3), (S4), (S5), (S6), (S7) and (S8). (S1) and (S2) are shown in FIG. 4. (S3) and (S4) are shown in FIG. 5. (S5) and (S6) are shown in FIG. 6. (S7) and (S8) are shown in FIG. 7. (S1) of FIG. 4 is an address. (S2) of FIG. 4 is a take-back. (S3) of FIG. 5 is a top-of-swing (top). In general, in the top-of-swing, the movement speed of a head is the minimum during the swing. (S4) of FIG. 5 is a downswing. (S5) of FIG. 6 is also a downswing. (S5) is in a state where the downswing advances as compared with (S4). (S6) of FIG. 6 is an impact. The impact is the moment when the head of the golf club c1 collides with the golf ball b1. (S7) of FIG. 7 is a follow-through. (S8) of FIG. 7 is a finish. The swing is concluded at the finish.

In the swing analysis system 2, data at least a time point (one time) during the swing is measured. Preferably, data at two times or three or more times during the swing are measured. More preferably, time-series data of a part of the section or the whole section during the swing is measured.

Data to be analyzed is acceleration data at one time or two or more times measured by the acceleration measuring device 4, or data calculated from this acceleration data.

The following three kinds of acceleration data are measured by the acceleration measuring device 4.

(1a) Acceleration data Ax in the x-axis direction (2a) Acceleration data Ay in the y-axis direction (3a) Acceleration data Az in the z-axis direction In the preferred present invention, the plurality of acceleration measuring devices 4 are used. In this case, the plurality of acceleration data Ax, the plurality of acceleration data Ay, and the plurality of acceleration data Az are obtained. Analysis diversity is enhanced by using the plurality of acceleration measuring devices 4. In the embodiment of FIG. 1, the two acceleration measuring devices 4 are used.

The acceleration data Ax, the acceleration data Ay, and the acceleration data Az maybe data at one time or at a plurality of times of two or more, and may be time-series data. In light of enhancing the analysis diversity, the acceleration data Ax, the acceleration data Ay, and the acceleration data Az are preferably time-series data. The time-series data is a set of data obtained at predetermined time intervals, and has acceleration data for each time. The time interval of this time-series data is determined by, for example, the sampling frequency of the acceleration measuring device 4. The larger the sampling frequency is, the more largely the number of data obtained per second increases.

The time-series acceleration data are obtained as data from a time Tm1 to a time Tm2 during the swing. The time Tm1 and the time Tm2 are not particularly limited as long as the time Tm1 and the time Tm2 are during the swing.

The measuring section may be all of the swing time, and may be a part of the swing time. The data to be analyzed may be data at one time or two or more times during the swing, and may be time-series data from the time Tm1 to the time Tm2.

Preferably, the measuring section includes the top-of-swing (merely also referred to as top) to the impact. Preferably, the time-series data to be analyzed includes from the top-of-swing to the impact. It is because the feature of the swing of each golf player tends to appear between the top-of-swing and the impact. Of course, the measuring section may include the time of the take-back, downswing or follow-through. The measuring section may be the address to the finish. It is also possible to set a comparatively short time to the measuring section, for example, to set only a time close to the impact to the measuring section. The measuring section can be suitably determined according to the object of the swing analysis or the like.

Examples of data calculated from the acceleration data measured by the acceleration measuring device 4 include the following items (1b) and (2b).

(1b) Data calculated by using two or three data selected from the group consisting of the data Ax, the data Ay, and the data Az.

(2b) Data calculated by using the data of the item (1b) obtained from the two or more acceleration measuring devices 4.

Examples of the data of the item (1b) include three-dimensional data of acceleration. This three-dimensional data is obtained by the vectorial sum of the data Ax, data Ay, and data Az. For example, the magnitude of the acceleration is calculated by $(Ax^2+Ay^2+Az^2)^{1/2}$.

In light of the analysis accuracy, when the two or more acceleration measuring devices 4 are used, the data are preferably synchronized. The relevance of data between the two or more acceleration measuring devices 4 can be analyzed by this synchronization.

The acceleration data to be analyzed may be data obtained from one swing, and may be data obtained from a plurality of swings. For example, the data analysis of the same golf club swung plural times by the same person is an effective indication for determining the repeatability of the swing. Useful data can be obtained by comparing swing data of different testers. For example, a plurality of data of the same golf club swung by the different testers are useful for classifying the feature of the swing of each of the testers.

SPECIFIC EXAMPLE 1 OF ANALYSIS

For example, the following analyses are possible. These analyses provide various indications related to the adoptability of the golf club to the golf player, the characteristics of the golf club, and a difference in a swing between the different golf players, or the like. The following analyses can be applied to all of the data calculated from the acceleration data Ax, the acceleration data Ay, the acceleration data Az, and at least one of the acceleration data. The data calculated from the acceleration data Ax, Ay, Az, and at least one of the acceleration data include a case of using Ax, Ay and Az as vector data. As described above, the measuring section is not limited either. In this application, the time Tm1 means one time in the measuring section, and is not particularly limited.

(1c) A difference between acceleration A1 at the time Tm1 and the maximum acceleration Amax in the measuring section.

(2c) A difference between the acceleration A1 at the time Tm1 and the minimum acceleration Amin in the measuring section.

(3c) A difference between the maximum acceleration Amax in the measuring section and the minimum acceleration Amin in the measuring section.

(4c) A time difference Td1 between a time when the maximum acceleration Amax is attained and a time when the minimum acceleration Amin is attained.

(5c) A difference between acceleration at the time Tm1 in the measuring section and acceleration at the time Tm2 in the measuring section.

(6c) The maximum acceleration Amax in the measuring section.

(7c) The minimum acceleration Amin in the measuring section.

(8c) The acceleration A1 at the time Tm1.

(9c) A mean value of accelerations between the time Tm1 and the time Tm2 in the measuring section.

(10c) A mean value of absolute values of the accelerations between the time Tm1 and the time Tm2 in the measuring section.

SPECIFIC EXAMPLE 2 OF ANALYSIS

Furthermore, the following analyses are possible for a graph line obtained from data calculated from the acceleration data Ax, the acceleration data Ay, the acceleration data Az, and at least one of the acceleration data. When this graph line is a two-dimensional orthogonal coordinate system, the contents of a vertical axis and horizontal axis are not limited. That is, the horizontal axis maybe, for example, a time. Furthermore, the horizontal axis may be all data calculated from the acceleration data Ax, Ay, Az, and at least one of the acceleration data. The vertical axis may be, for example, a time. Furthermore, the vertical axis may be all data calculated from the acceleration data Ax, Ay, Az, and at least one of the accerelation data. The data calculated from the acceleration data Ax, Ay, Az, and at least one of the accerelation data include a case of using the acceleration data Ax, Ay, and Az as the vector data. As described above, the measuring section is not limited either. In this application, the time Tm1 means one time in the measuring section, and is not particularly limited. Hereinafter, a value of the graph line is a value of the vertical axis.

(1d) A difference between the value of the graph line at the time Tm1 and the maximum value of the graph line in the measuring section.

(2d) A difference between the value of the graph line at the time Tm1 and the minimum value of the graph line in the measuring section.

(3d) A difference between the maximum value of the graph line in the measuring section and the minimum value of the graph line in the measuring section.

(4d) A time difference between a time when the value of the graph line is the maximum value and a time when the value of the graph line is the minimum value.

(5d) A difference between the values of the graph line at the time Tm1 in the measuring section and the time Tm2 in the measuring section.

(6d) The maximum value of the graph line in the measuring section.

(7d) The minimum value of the graph line in the measuring section.

(8d) A value of the graph line at the time Tm1.

(9d) A mean value of the values of graph line between the time Tm1 and the time Tm2 in the measuring section.

(10d) A mean value of absolute values of values of graph line between the time Tm1 and the time Tm2 in the measuring section.

SPECIFIC EXAMPLE 3 OF ANALYSIS

Furthermore, diversified analyses are possible in the present invention, including the specific example 1 and the specific example 2. For example, the following analyses are possible for a value C1 selected from the data calculated from the acceleration data Ax, the acceleration data Ay, the acceleration data Az, and at least one of the acceleration data. This value C1 includes a case of using the acceleration data Ax, Ay, and Az as the vector data. This value C1 includes all values calculated based on data obtained by the measurement of this application. As described above, the measuring section is not limited either.

(1e) A difference between a value C1 at the time Tm1 and the maximum value of a value C1 in the measuring section.

(2e) A difference between the value C1 at the time Tm1 and the minimum value of the value C1 in the measuring section.

(3e) A difference between the maximum value of the value C1 in the measuring section and the minimum value of the value C1 in the measuring section.

(4e) A time difference between a time when the value C1 is the maximum value and a time when the value C1 is the minimum value.

(5e) A difference between values C1 at the time Tm1 in the measuring section and the time Tm2 in the measuring section.

(6e) The maximum value of the value C1 in the measuring section.

(7e) The minimum value of the value C1 in the measuring section.

(8e) The value C1 at the time Tm1.

(9e) The mean value of the values C1 between the time Tm1 and time Tm2 in the measuring section.

(10e) The mean value of absolute values of the value C1 between the time Tm1 and the time Tm2 in the measuring section.

Among these, the items (3c) and (4c) are particularly preferable. It is believed that these items (3c) and (4c) are characteristic indications in the graph line, and tend to develop a significant difference. The items (3c) and (4c) are indications understandable for the golf player.

As the time Tm1, the start of the swing, the top-of-swing, the impact, and the like are exemplified. In light of realizing the feature of the swing, the time Tm1 is preferably the top-of-swing or the impact, and more preferably the top-of-swing. In light of realizing the feature of the swing, the start time (time 0) of the measuring section is preferably the time Tm1.

The time Tm2 is not limited as long as the time Tm2 is later than the time Tm1. As the time Tm2, the top-of-swing, the impact, the finish, and the like are exemplified. In light of capturing the feature of the swing, the time Tm2 is preferably the impact. In light of capturing the feature of the swing, the finishing time of the measuring section is preferably the time Tm2.

The repeatability of the swing is useful information. For example, this repeatability can be an indication which determines the adoptability of a specific golf club to a specific golf player. That is, the golf club having high repeatability can be determined to conform to the golf player with a high possibility. The repeatability is determined by the difference of the data during the plurality of swings. The number of times of swings when determining the repeatability is not limited, and may be twice, or may be three or more times.

For example, the same golf player swings different golf clubs, and can compare the repeatabilities. The golf club having higher repeatability can be determined to be relatively suitable for the golf player. The same golf player can swing a plurality of kinds of golf clubs which are different only in a shaft, and can compare the repeatabilities. The shaft having higher repeatability can be determined to be relatively suitable for the golf player.

Thus, the specification suitable for the golf player can be found by swinging the plurality of golf clubs which are different only in specific specification and by comparing the repeatabilities. This specification is not limited, and is, for example, a flex of a shaft, a shaft torque, a swing balance, a grip size, a grip material, a position of center of gravity (a depth of center of gravity, a distance of center of gravity or the like) of a head, a club length, a club weight, or the like.

Examples of the indication which determines the repeatability include at least a value selected from the group consisting of the items (1c), (2c), (3c), (4c), (5c), (6c), (7c), (8c), (9c), (10c), (1d), (2d), (3d), (4d), (5d), (6d), (7d), (8d), (9d), (10d), (1e), (2e), (3e), (4e), (5e), (6e), (7e), (8e), (9e) and (10e). The plurality of swings are measured, and the approximations of these values are determined. When this approximation is higher, the repeatability can be determined to be higher. That is, when variation is less in the plurality of swings, the repeatability can be determined to be higher.

The followings are exemplified as preferred indications for determining the repeatabilities. The indications of these repeatabilities are based on a plurality of swing data. For example, the indications of the repeatabilities are based on data obtained by the same golf club swung plural times by the same tester. The following indications can be applied to all of the values C1. As described above, the measuring section is not limited either. The undermentioned time Tm1 means one time in the measuring section, and is not limited. The plurality of swings may be, for example, two swings of a swing A and swing B, and may be three or more swings. The swing A and the swing B may be two swings selected from three or more swings.

(1f) An absolute value of a difference between the values C1 during the plurality of swings at a time when the difference is the maximum value.

(2f) A mean value of the differences between the values C1 during the plurality of swings in the measuring section.

(3f) A mean value of the absolute values of the differences between the values C1 during the plurality of swings in the measuring section.

(4f) An area s1 of a portion surrounded by a plurality of graph lines drawn by the plurality of swings. However, the horizontal axis of a graph is set to a time or one of the values C1, and the vertical axis of the graph is set to a time or one of the values C1. The vertical axis and the horizontal axis are not limited as long as the vertical axis and the horizontal axis are different. In this application, the graph line is a polygonal line obtained by connecting points plotted as the time-series data of the values C1 with a straight line.

(5f) An absolute value of a difference between the maximum value of the values C1 in the swing A and the maximum value of the values C1 in the swing B. These maximum values are the maximum value of each of the swings in the same measuring section, and a time having the maximum value may be different between the swing A and the swing B.

(6f) An absolute value of a difference between a time Ta1 when the value C1 is the maximum value in the swing A and a time Tb1 when the value C1 is the maximum value in the swing B (Ta1−Tb1).

(7f) An absolute value of a difference between the minimum value of the values C1 in the swing A and the minimum value of the values C1 in the swing B. These minimum values are the minimum value of each of the swings in the same measuring section, and a time having the minimum value may be different between the swing A and the swing B.

(8f) An absolute value of a difference between a time Tat when the value C1 is the minimum value in the swing A and a time Tb2 when the value C1 is the minimum value in the swing B (Ta2−Tb2).

The followings are exemplified as preferred indications for determining the repeatabilities. The indications of these repeatabilities are based on a plurality of swing data. For example, the indications of these repeatabilities are based on data obtained by swinging the same golf club plural times by the same tester. The following indications can be applied to each of the acceleration data Ax, the acceleration data Ay, and the acceleration data Az. As described above, the measuring section is not limited either. The undermentioned time Tm1 means a time in the measuring section, and is not limited.

(1g) An absolute value of a difference Admax between the accelerations during the plurality of swings at a time when the difference Ad is the maximum value (Admax).

(2g) A mean value of the differences Ad between the accelerations during the plurality of swings in the measuring section.

(3g) A mean value of the absolute values of the differences Ad between the accelerations during the plurality of swings in the measuring section.

(4g) An area s1 of a portion surrounded by a plurality of graph lines drawn by the plurality of swings. However, this graph line is a polygonal line obtained by connecting points plotted as the time-series data of the acceleration with a straight line in a graph with a horizontal axis set to a time and a vertical axis set to acceleration.

(5g) An absolute value of a difference between the maximum value of the acceleration in the swing A and the maximum value of the acceleration in the swing B. These maximum values are the maximum value of each of the swings in the same measuring section, and a time having the maximum value may be different between the swing A and the swing B.

(6g) An absolute value of a difference between a time Ta1 when the acceleration is the maximum value in the swing A and a time Tb1 when the acceleration is the maximum value in the swing B (Ta1−Tb1).

(7g) An absolute value of a difference between the minimum value of the acceleration in the swing A and the minimum value of the acceleration in the swing B. These minimum values are the minimum value of each of the swings in the same measuring section, and a time having the minimum value may be different between the swing A and the swing B.

(8g) An absolute value of a difference between a time Tat when the acceleration is the minimum value in the swing A and a time Tb2 when the acceleration is the minimum value in the swing B (Ta2−Tb2).

Among these, the item (4g) is particularly preferable. The time-series data of a predetermined section is reflected in the area s1. Therefore, this area s1 is excellent as the indication of the repeatability as compared with a case of using data of only a specific time. When the area s1 is smaller, the repeatability can be determined to be higher.

In the present invention, in place of the acceleration data Ax, the acceleration data Ay, or the acceleration data Az, the absolute value of the acceleration data Ax, the absolute value of the acceleration data Ay, or the absolute value of the acceleration data Az may be used. When analysis in which the magnitude of the acceleration poses a problem as compared with the direction of the acceleration is performed, the analysis using the absolute value is effective.

In the present invention, in place of the acceleration data Ax, the acceleration data Ay, or the acceleration data Az, data calculated using two or three data selected from the group containing these acceleration data Ax, Ay, and Az may be used. As this calculation method, for example, addition, subtraction, multiplication, and division of two or three data selected from the group consisting of the acceleration data Ax, Ay, and Az, and addition, subtraction, multiplication, and division of two or the three data selected from the group consisting of the absolute value of the acceleration data Ax, the absolute value of the acceleration data Ay and the absolute value of the acceleration data Az are exemplified. These calculation data can have a meaning peculiar to each of the formulae. The feature of the swing and the repeatability of the swing can be determined based on these calculation data. The relevance between calculation data and the swing can be found by comparing various calculation data with the swing. The correlation between various calculation data and hitting results can be found by comparing the calculation data with the impact results. These calculation data can be useful for the swing analysis.

When the two or more acceleration measuring devices are used, a value calculated by using the measured values of the plurality of devices may be used for analysis. For example, when data (Ax, Ay, Az) of a first acceleration measuring device are set to (Ax1, Ay1, Az1) and data (Ax, Ay, Az) of a second acceleration measuring device are set to (Ax2, AV2, Az2), a value calculated from two, or three or more data selected from the group consisting of Ax1, Ay1, Az1, Ax2, Ay2, and Az2 maybe used for analysis. Examples of this value include the addition, subtraction, multiplication, and division of the acceleration data (Ax1 and Ax2) in the x-axis direction; the addition, subtraction, multiplication, and division of the acceleration data (Ay1 and Ay2) in the y-axis direction; and the addition, subtraction, multiplication, and division of the acceleration data (Az1 and Az2) in the z-axis direction.

The data Ax, the data Ay, and the data Az are also vector data. Therefore, the swing analysis may be performed by analyzing these vectors. For example, the direction of the acceleration, the direction of a force, the angle of the acceleration, and the angle of the force can be analyzed by analyzing these vectors. An example of this vector analysis will be shown in examples to be described later.

A trigger signal is preferably used in the measurement. The measurement is preferably started by the trigger signal. Preferably, the acceleration data is associated with the swing motion in time series based on this trigger signal. More preferably, the generating time point of the trigger signal is set to a time 0 (zero).

The timing of generating the trigger signal is not limited. The correlation between the acceleration data and the swing is more easily understood by setting the characteristic scene during the swing to a reference time. In this respect, the trigger signal is preferably the start time point of the take-back, the top-of-swing or the impact, more preferably the top-of-swing, or the impact, and still more preferably the top-of-swing.

As described above, the measuring section is not limited. As described above, the measuring section can be appropriately set in view of the evaluation object or the like. The followings are exemplified as the measuring sections.

(1) From the address to the finish (that is, whole swing)
(2) From the address to the impact
(3) From the address to the top-of-swing
(4) From the top-of-swing to the impact
(5) From the impact to the finish
(6) A part of the sections of the above items (1) to (5)

As described above, particularly, the feature of the swing is likely to appear between the top-of-swing and the impact. The movement between the top-of-swing and the impact has the large correlation with the hitting results. In these respects, the measuring section is preferably from the top-of-swing to the impact. In light of performing analysis with higher accuracy using fewer data, the measuring section is preferably from the top-of-swing to the impact.

The trigger signal may be automatically generated, or may be manually generated. As an example of a method for manually generating the trigger signal, an observer pushes a switch or the like at a predetermined timing while watching swing or a swing image to generate the trigger signal. For example, when the trigger signal is generated at the time point of the top-of-swing, the observer may confirm the top-of-swing (the state of (S3) of FIG. 5), and may push the switch or the like.

A trigger device for automatically generating the trigger signal may be used. This trigger device has, for example, a laser sensor. The trigger device may generate the trigger signal when the laser of this laser sensor is interrupted by a head, a shaft, or the like. The trigger device may generate the trigger signal when the hit ball interrupts the laser. The trigger device may generate the trigger signal upon detection of a hitting sound. The trigger device may generate the trigger signal when the head interrupts the laser at the time of the start of the take-back.

The trigger device may have an acceleration sensor attached to the head and may generate the trigger signal when this acceleration sensor detects an impact force upon the impact. When the trigger signal is generated at the moment of impact, a predetermined time before and/or after the impact (for example, for 0.2 to 0.5 seconds before the impact) may be set as data take-in time.

The trigger signal may be generated automatically by the image processing of the swing image. For example, a moment at which the absolute value of the speed of the head, shaft, or grip is the minimum (typically 0) may be detected by the image processing, and the trigger signal may be generated at this moment. In this case, the time point of the top-of-swing can be detected automatically.

As described above, the swing analysis method of the present invention includes the steps of: preparing the radio type three-dimensional acceleration measuring device capable of measuring respective accelerations in three axis directions of the x-axis direction, the y-axis direction, and the z-axis direction; mounting the three-dimensional acceleration measuring device to the golf player's body; receiving the measured data from the acceleration measuring device during the swing through the radio communication; and analyzing a golf swing based on the acceleration data. Preferably, time-series data of acceleration shown in examples to be described later are obtained by this analysis method.

Preferably, the acceleration data has a component of the cross direction (Z-axis direction). In the embodiment, the acceleration data Az in the z-axis direction has a component of the cross direction (Z-axis direction). The tendency of the acceleration in the cross direction (Z-axis direction) can be known by analyzing this acceleration data Az.

It is believed that the acceleration in the horizontal direction (X-axis direction) has large correlation with a head speed. It is believed that the acceleration in the horizontal direction (X-axis direction) is an indication of important movement in swing such as a weight shift and sway. It is believed that the tilt angle of the shaft and the flexure of the shaft have large correlation with the acceleration in the vertical direction (Y-axis direction). It is believed that the magnitude of the movement in the vertical direction (Y-axis direction) is likely to appear as the feature of the swing. On the other hand, the acceleration in the cross direction (Z-axis direction) was expected to being not so important as compared with the horizontal direction (X-axis direction) or the vertical direction (Y-axis direction). However, according to the data obtained in the present invention, the acceleration in the cross direction (Z-axis direction) was found to be important for the swing analysis. Therefore, it was revealed that the acceleration in the z-axis direction can be an indication showing the feature and repeatability or the like of the swing.

The analysis method of the present invention can be utilized also for judgement on the quality of the swing. For example, when excessive acceleration change is observed in a part (for example, the vicinity of the neck) which must not move so much essentially, the presence of useless movement in the part can be confirmed.

[Number and Positions of Acceleration Measuring Devices]

The number of the mounted acceleration measuring devices is not limited. In light of enabling diversified analysis, the number of attached acceleration measuring devices is preferably two or more. The upper limit of the number is not particularly limited. However, the number can be set to ten or less in view of a burden for analysis. Furthermore, the number can be set to five or less. In light of performing the diversified analysis, when two or more acceleration measuring devices are mounted, the maximum distance between the acceleration measuring devices is preferably 20 cm or more, more preferably 30 cm or more, and still more preferably 40 cm or more.

The attached position of the acceleration measuring device is not limited. As this position of the attached acceleration measuring device, a head, a face, a neck, an arm, a shoulder, an elbow, a back, a waist, a wrist, a belly, a hip, a knee, an ankle, a back of a hand, an instep, and the like are exemplified. The acceleration measuring device may be attached to clothes, or may be directly attached to a skin of a human body. The acceleration measuring device is preferably mounted to a part in which the feature of the swing is likely to appear. In this respect, the attached position of the acceleration measuring device is preferably the head, the neck, the shoulder, the back, the waist, or the wrist, and the number of the attached positions of the acceleration measuring devices is preferably two or more. More preferably, the acceleration measuring devices are attached to two or more parts selected from the group selected from the head, the neck, the shoulder, the back, the waist, and the wrist. In light of analysis diversity, the acceleration measuring device may be attached to the club in addition to the human body.

The sampling frequency is not limited. The time of the swing is as comparatively short as about 0.3 second to about 1 second. For highly accurate analysis, more data per unit time are preferable. In this respect, the sampling frequency is preferably equal to or more than 20 Hz, more preferably equal to or more than 50 Hz, still more preferably equal to or more than 100 Hz, and particularly preferably equal to or more than 200 Hz. The larger the sampling frequency is, the more the analysis accuracy is enhanced. Accordingly, fundamentally, the sampling frequency is preferably larger. When the number of data is excessive, the time of data processing is lengthened. There is a limit for the transmission speed of the radio communication. In the present, in view of the transmission speed of the practicable radio communication, the sampling frequency is preferably equal to or less than 400 Hz. As shown in examples to be described later, when the sampling frequency is 200 Hz, the highly accurate analysis is possible.

Large acceleration may be generated in the golf swing. In particular, large acceleration may be generated in a part having intense movement such as the wrist. In this respect, the maximum value (measuring limit acceleration) of measurable acceleration of the acceleration measuring device is preferably equal to or more than 3G, and more preferably equal to or more than 5G. In light of extending the measurable range, this maximum measuring acceleration is preferably larger.

The size and weight of the acceleration measuring device 4 are not limited. However, in light of not hindering the swing, the acceleration measuring device is preferably compact and light-weight. In this respect, the weight of the acceleration measuring device is preferably equal to or less than 10 g, and more preferably equal to or less than 6 g.

[Radio Communication]

A known standard or technique can be used as a method for the radio communication. A radio technique and standard generally spreading in radio LAN or the like can be used. Examples of the standard of the radio communication include IEEE802.11 series and IEEE802.15 series. "IEEE" means Institute of Electrical and Electronic Engineers. As IEEE802.15 series, Bluetooth (IEEE802.15.1), Ultra Wideband (UWB; IEEE 802.15.3a), and ZigBee (IEEE802.15.4) or the like are exemplified. Optical radio communication using infrared light, visible light, and the like may be used. In light of versatility and transmission speed or the like, Bluetooth is preferably used.

Bluetooth means radio communication standard which exchanges information using radio waves in a 2.4 GHz frequency range, and a technique thereof. Examples of the standard of this Bluetooth include 1.0b, 1.0 b+CE (Critical Errata) 1.1, 1.2, and 2.0, and 2.1. These all can be used for the present invention. Various profiles standardized in Bluetooth as communication protocol can be used. As the radio wave strength, class 1 (100 mW), class 2 (2.5 mW,) and class 3 (1 mW) are known. Any class may be used according to measurement conditions. In light of preventing the hindrance of the swing, the communication distance is preferably equal to or more than 10 m. In this respect, the class 1 (100 mW) or the class 2 (2.5 mW) is preferable.

The acceleration data is preferably measured in synchronism with the image of the swing. This synchronization is useful for analyzing the relevance between the acceleration data and the swing.

EXAMPLES

Hereinafter, advantages of the present invention will be explained by way of examples. However, the present invention should not be construed as being limited based on the description of the examples.

In a part of the following FIG. 8 to FIG. 40 (graphs), the terms "above", "below", "right", "left", "forth", and "back" are described. These terms "above", "below", "right", "left", "forth" and "back" have no strict sense. For example, in FIG. 8 to be described later, a vertical axis has notations of "right" and "left". The terms "right" and "left" have no strict sense. In other words, the terms "right" and "left" do not show the horizontal direction (X-axis direction) strictly. As described above, the "x-axis direction" of an acceleration sensor is not fully matched with the horizontal direction (X-axis direction). As described above, the acceleration of "the X-axis direction" shows the tendency of the acceleration of the horizontal direction (X-axis direction). In view of this description, in light of facilitating the understanding of the graph, a direction (plus direction) in which the acceleration in the x-axis direction increases is described as "→right", and a direction (minus direction) in which the acceleration in the x-axis direction decreases is described as "→left". The terms "above", "below", "right", "left", "forth", and "back" in the other graphs have the same sense.

Example 1

As shown in FIGS. 1 and 2, two acceleration measuring devices 4 were attached to a tester t1. As the acceleration measuring device 4, an acceleration measuring device manufactured by Bycen Co., Ltd. was used. For the specification of this acceleration measuring device, the total weight of the acceleration measuring device is 6 g; a power supply is a button battery; the maximum measuring acceleration is 5 G; and a sampling frequency is 200 Hz.

The tester t1 swung, and the acceleration of the swing was measured. An observer confirmed a top-of-swing visually and pushed a switch for generating a trigger signal at the moment of the top-of-swing. The time of the top-of-swing was set to 0 (zero), and the measurement was performed. A section between the top-of-swing and the impact was set to a measuring section.

Mr. A and Mr. B as testers performed the measurements.

Figure 8:
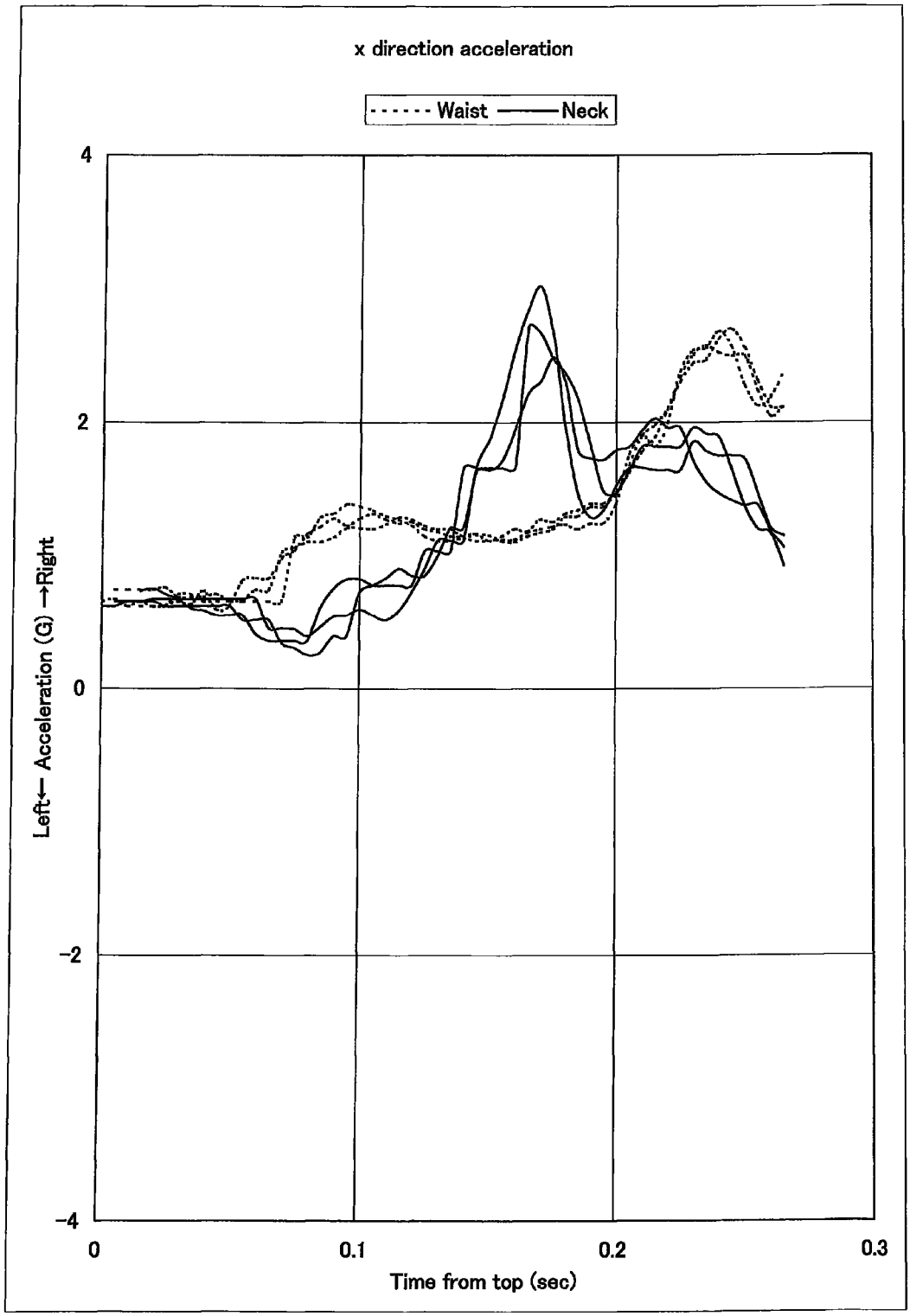
FIG. 8 shows an example of graph lines showing the measuring result of time-series data of acceleration in an x-axis direction.
Figure 9:
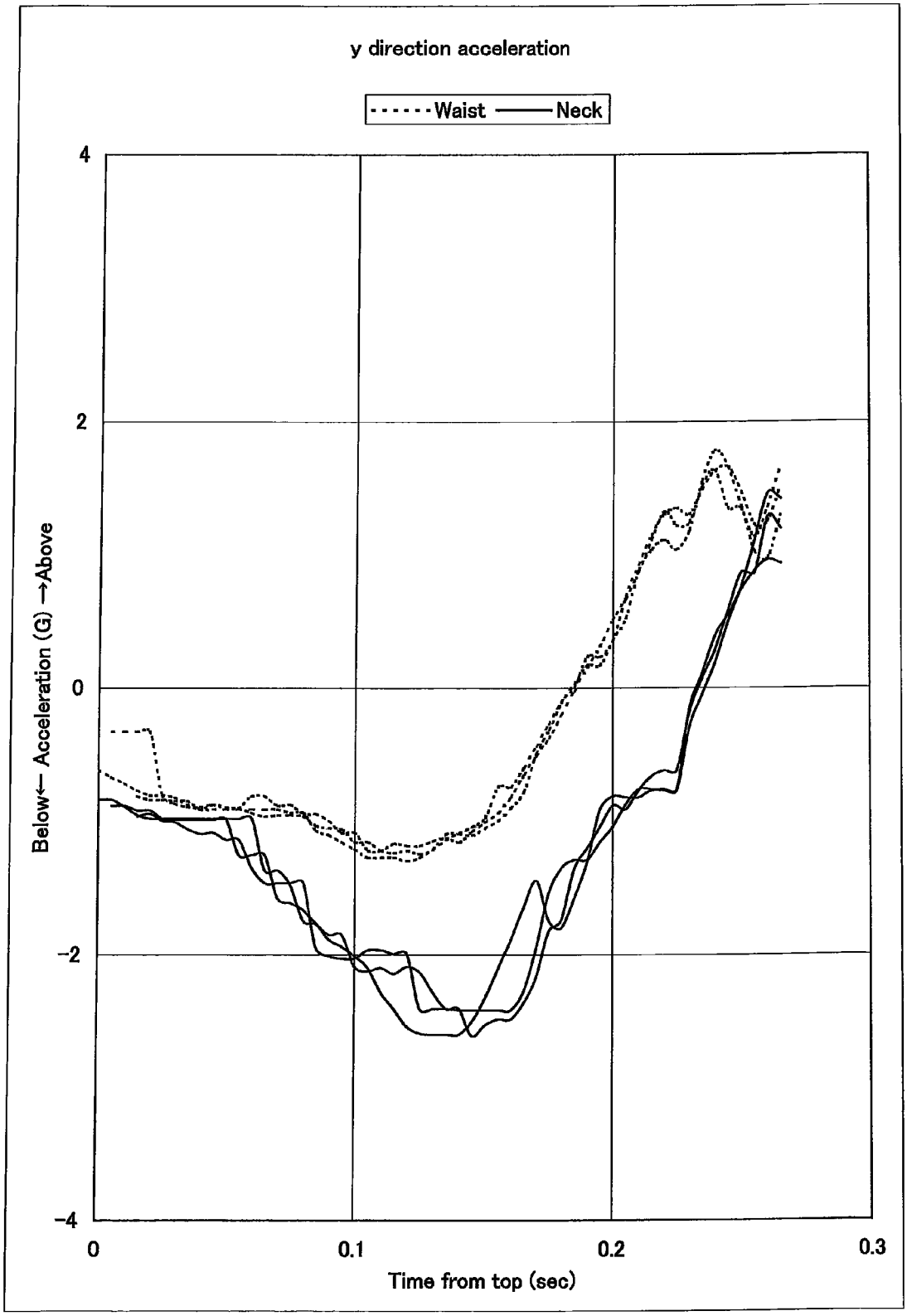
FIG. 9 shows an example of graph lines showing the measuring result of time-series data of acceleration in a y-axis direction.
Figure 10:
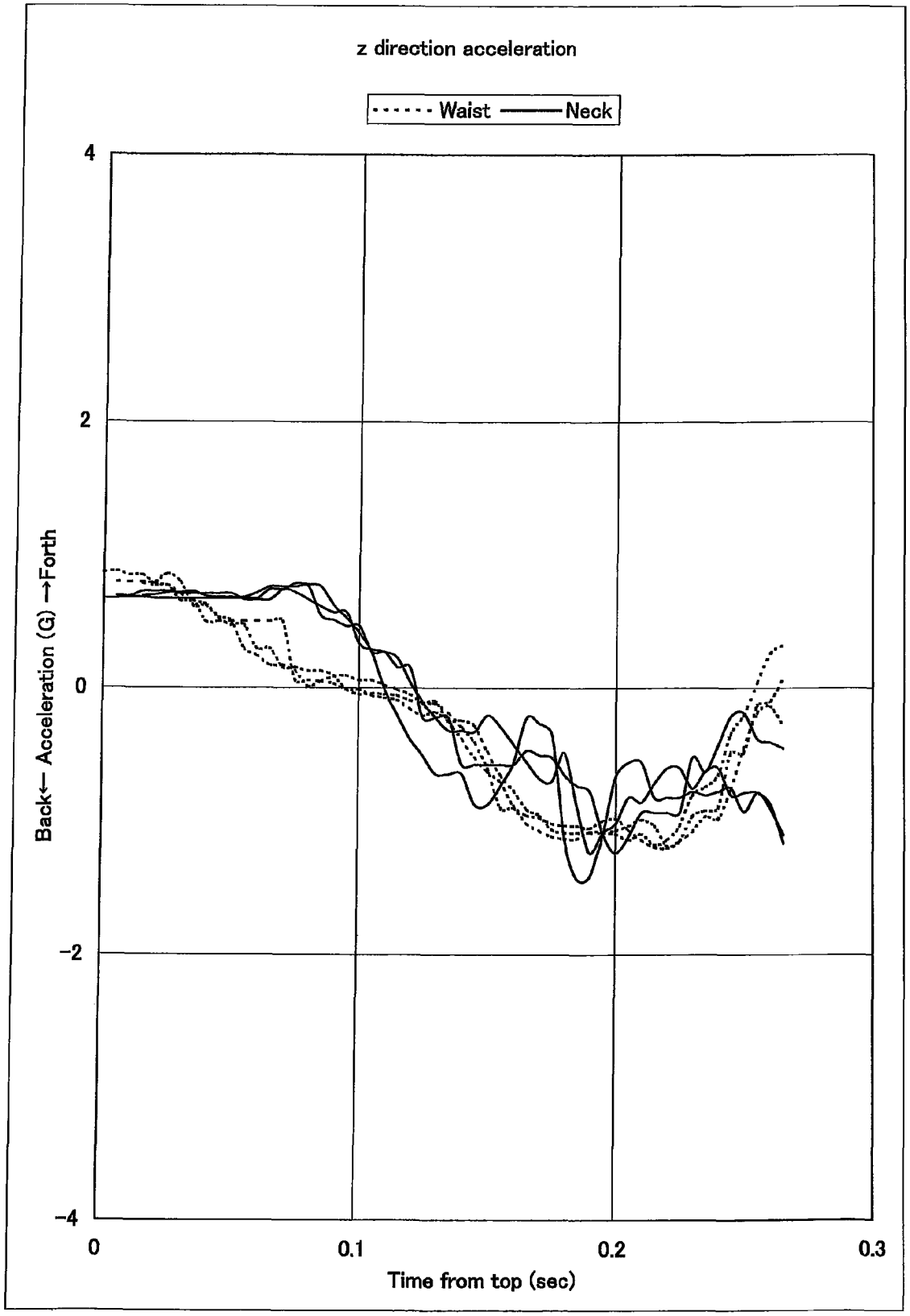
FIG. 10 shows an example of graph lines showing the measuring result of time-series data of acceleration in a z-axis direction.

FIGS. 8, 9 and 10 are [time-acceleration] graphs showing Mr. A's measuring results. FIG. 8 shows graph lines of acceleration data in an x-axis direction. FIG. 9 shows graph lines of acceleration data in a y-axis direction. FIG. 10 shows graph lines of acceleration data in a z-axis direction. Among these graph lines, the broken lines show measured data based on the acceleration measuring device (the acceleration measuring device 41 of FIG. 2) attached to a waist. The solid lines show measured data based on the acceleration measuring device (acceleration measuring device 42 of FIG. 2) attached to a neck. Mr. A swung the same golf club three times. As the golf club, trade name "THE XXIO" (W#1, MP500 carbon shaft, flex "R") manufactured by SRI Sports Limited was used. Each of the three measuring results is shown in each of the graphs. Therefore, in each of the graphs, three graph lines showing the measuring results of the acceleration measuring device 41 are drawn, and three graph lines showing the measuring results of the acceleration measuring device 42 are drawn. The three solid lines are not the same at all. The deviation amount of the three solid lines correlates with the repeatability of the swing. Similarly, the deviation amount of the three broken lines correlates with the repeatability of the swing. It is believed that the fewer the deviation amount is, the higher the repeatability of the swing is. The high repeatability of the swing is important in the fitting of the golf club. The high repeatability of the swing can be one of the indications showing that the golf club is suitable for the tester.

Figure 11:
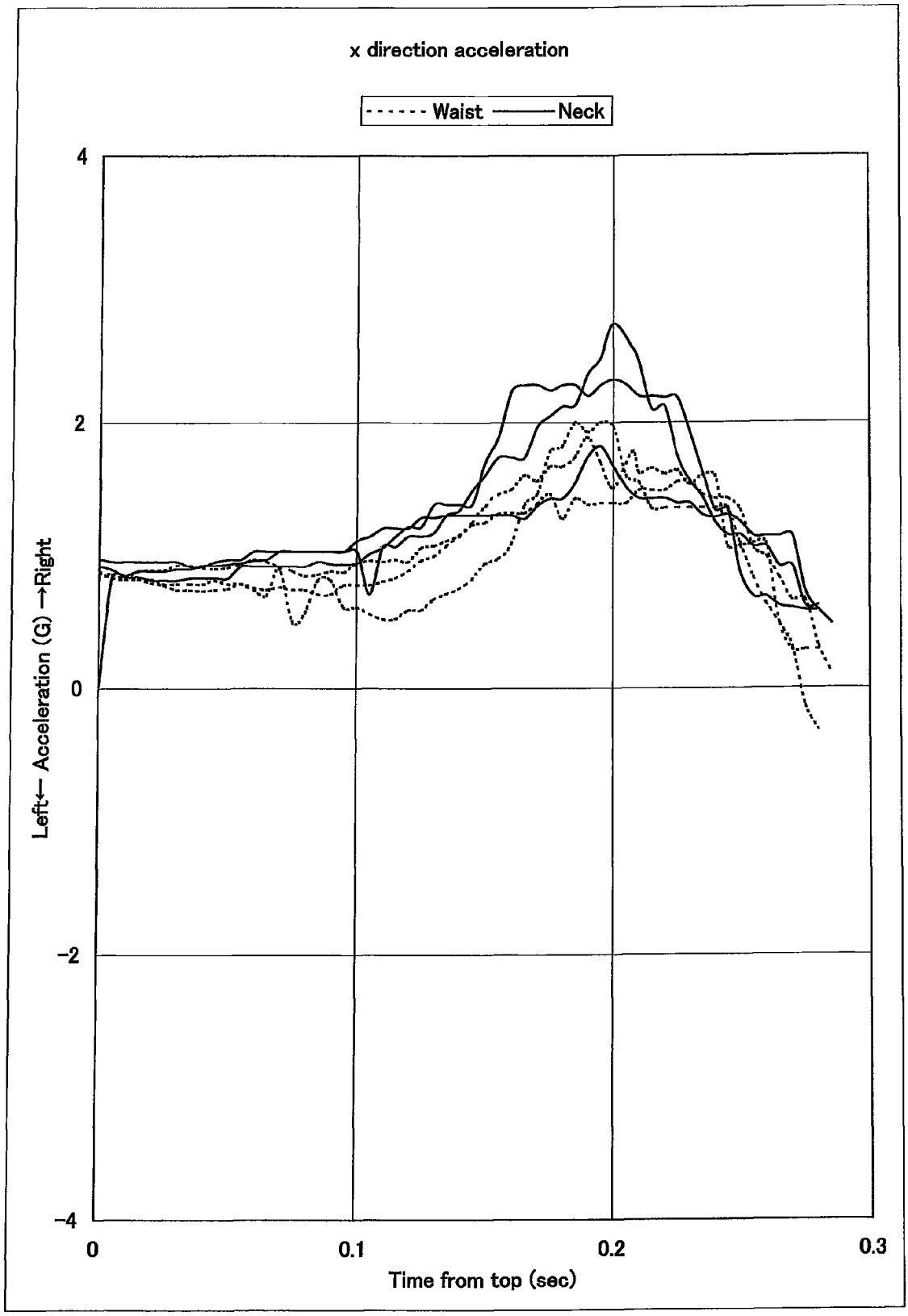
FIG. 11 shows another example of graph lines showing the measuring result of time-series data of acceleration in an x-axis direction.
Figure 12:
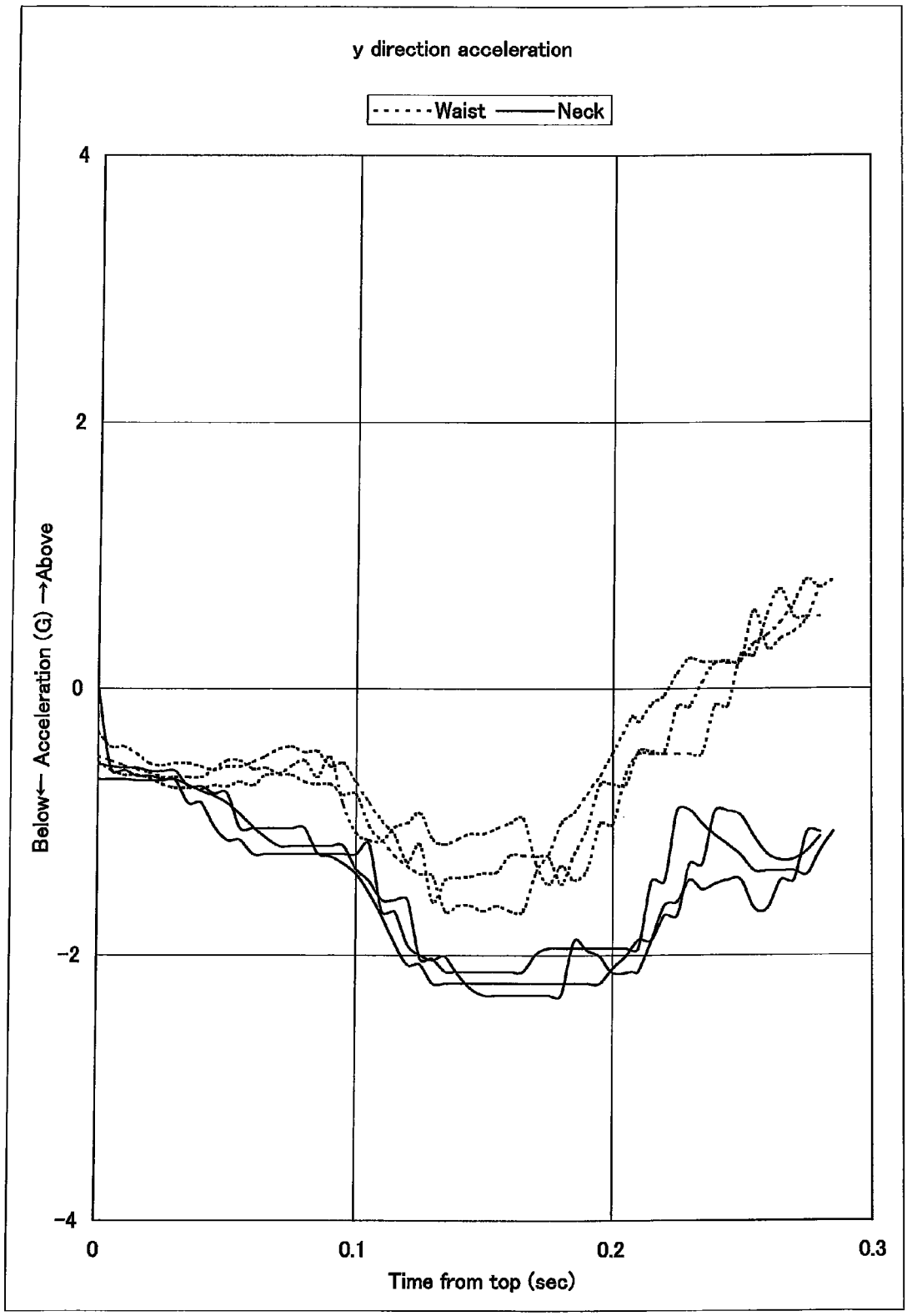
FIG. 12 shows another example of graph lines showing the measuring result of time-series data of acceleration in a y-axis direction.
Figure 13:
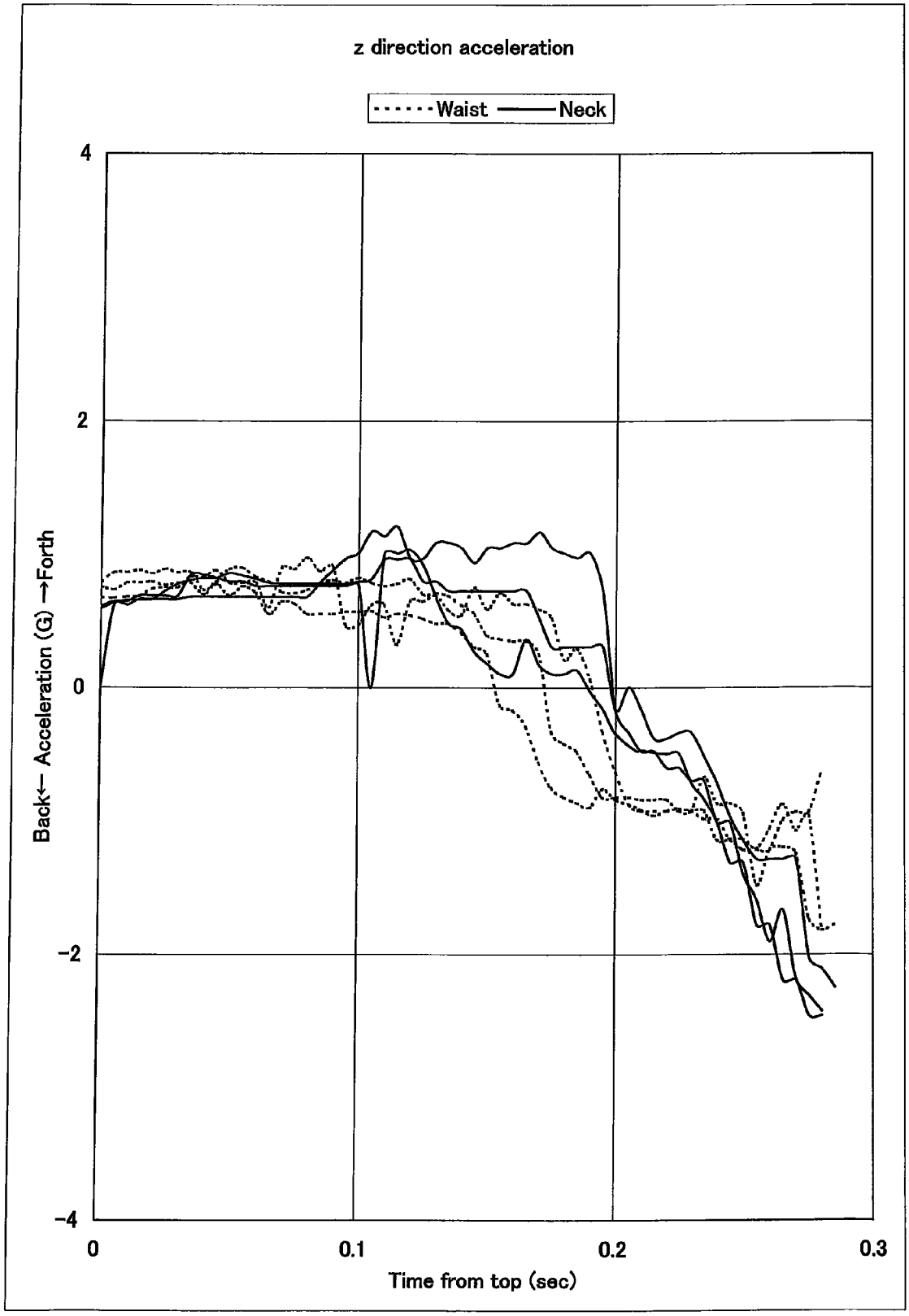
FIG. 13 shows another example of graph lines showing the measuring result of time-series data of acceleration in a z-axis direction.

FIGS. 11, 12, and 13 are [time-acceleration] graphs showing Mr. B's measuring results. FIG. 11 is a graph of acceleration data in an x-axis direction. FIG. 12 is a graph of acceleration data in a y-axis direction. FIG. 13 is a graph of acceleration data in a z-axis direction. In these graphs, the broken lines show measured data based on the acceleration measuring device (the acceleration measuring device 41 of FIG. 2) attached to a waist. The solid lines show measured data based on the acceleration measuring device (acceleration measuring device 42 of FIG. 2) attached to a neck. Mr. B swung the same golf club three times. As the golf club, the golf club used by Mr. A was used. Each of the three measuring results is shown in each of the graphs. Therefore, in each of the graphs, three graph lines showing the measuring results of the acceleration measuring device 41 are drawn, and three graph lines showing the measuring results of the acceleration measuring device 42 are drawn.

Mr. A's data were compared with Mr. B's data. Even though Mr. A and Mr. B swung the same golf club, it can be seen that the data have a significant difference. These acceleration data can show the feature of the swing of each of the golf players.

As described above, the acceleration data can be applied to various analyses. These analysis results are quantitive. This quantitive data are excellent in reliability as compared with sensuous tests (feeling tests). For example, data in the case of generating good results can be determined by comparing the obtained data with the results of hit balls. The clarification of the data leading to the good results is useful for selecting a suitable golf club. For example, the acceleration data can be measured at the shop front of a golf shop, and the suitable golf club can be selected based on the results. The clarification of the data leading to the good results is useful for developing the golf club. The acceleration data is useful for classifying the swing. For example, the swing can be classified based on the pattern of the obtained graph lines. A suitable club for every classified swing can be developed by the acceleration data.

The results can determine, as the feature of Mr. A' swing, that acceleration change in the vertical direction (Y-axis direction) is comparatively large. It is believed that Mr. A shows comparatively high repeatability in the test club. That is, it can be believed that the test club has comparatively high adaptability to Mr. A.

On the other hand, the results can determine that acceleration change in any direction is comparatively small as the feature of Mr. B' swing. It is believed that Mr. B shows comparatively low repeatability in the test club. That is, it can be believed that the test club has comparatively low adaptability to Mr. B.

Example 2

Figure 14:
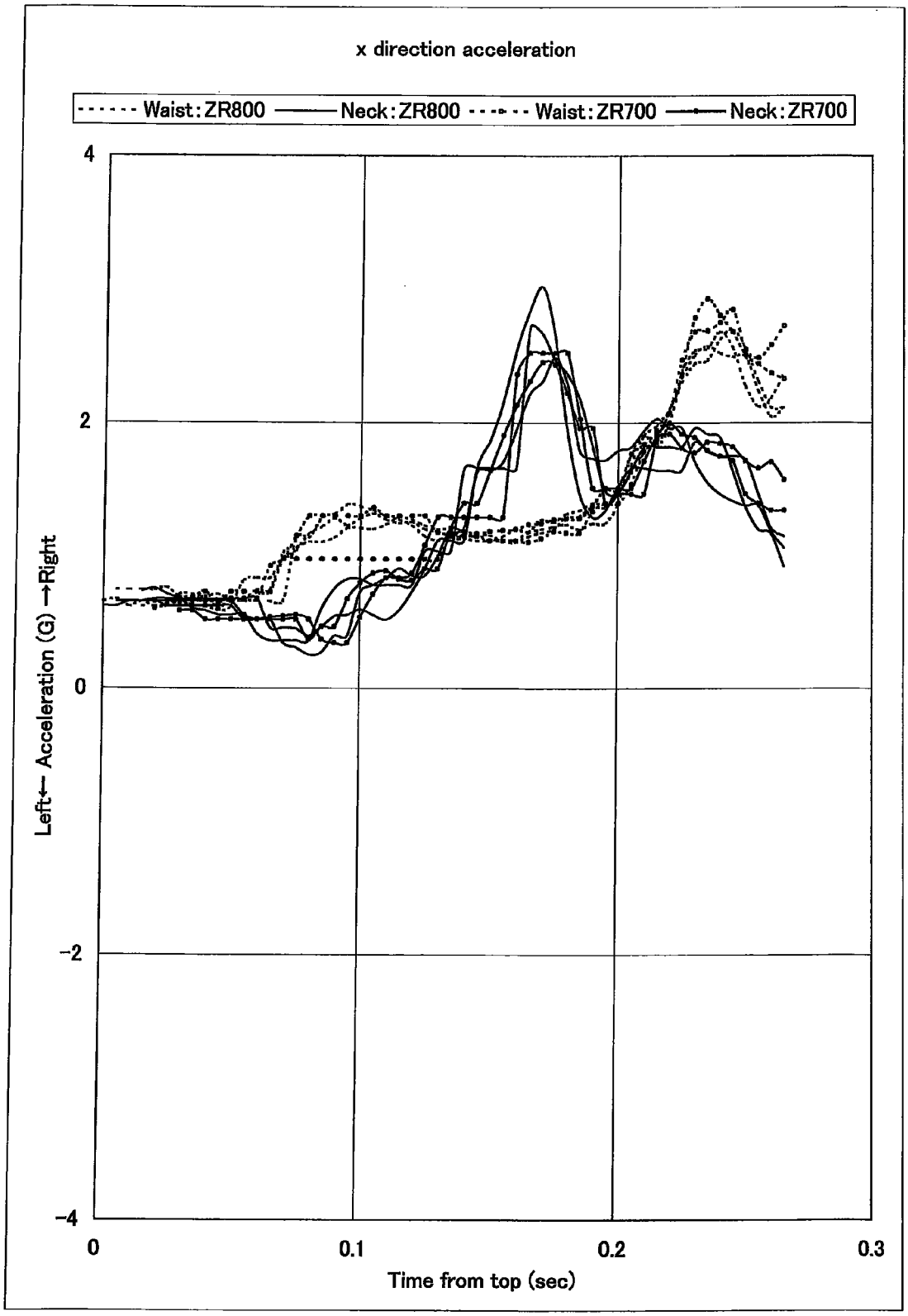
FIG. 14 shows another example of graph lines showing the measuring result of time-series data of acceleration in an x-axis direction.
Figure 15:
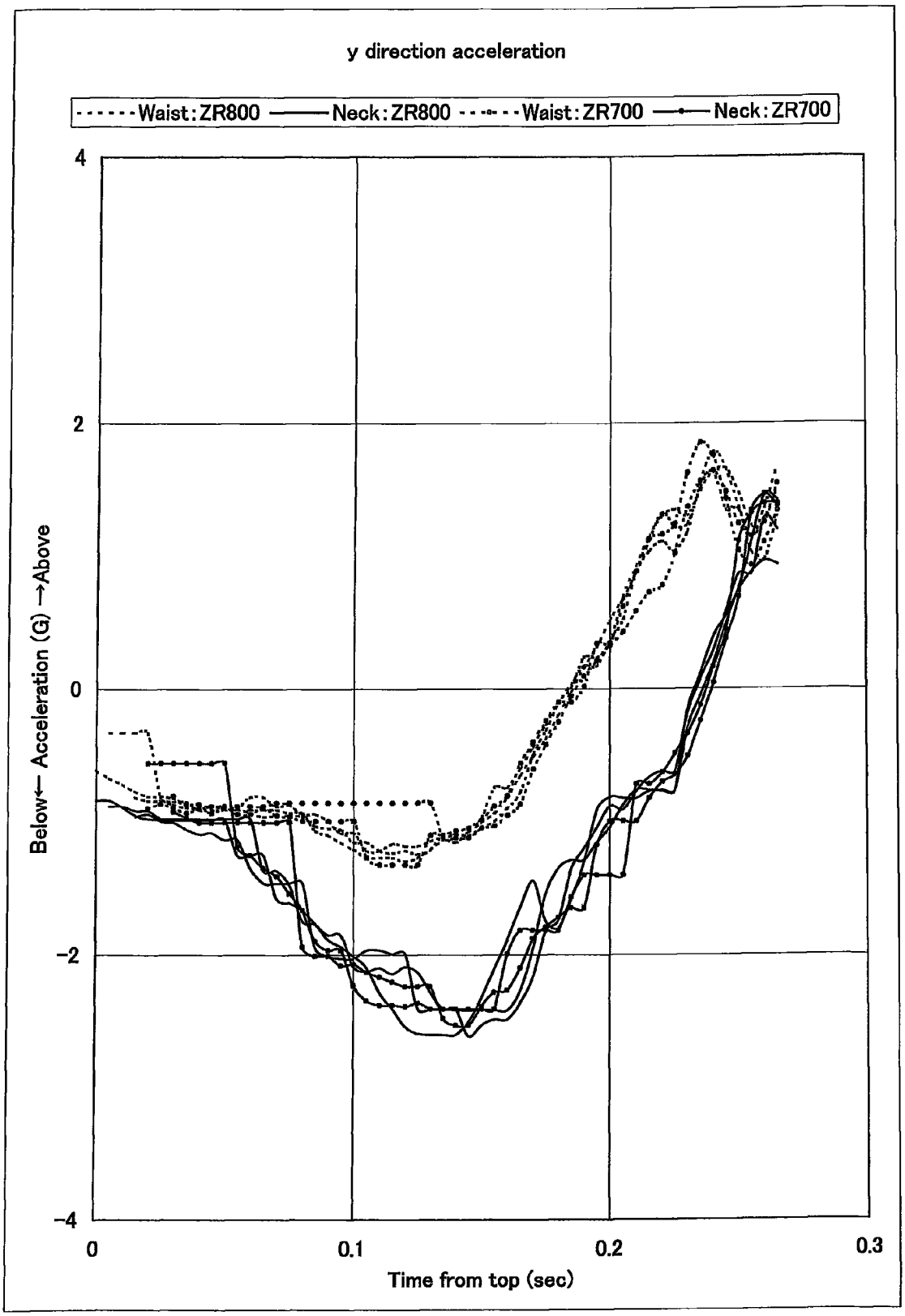
FIG. 15 shows another example of graph lines showing the measuring result of time-series data of acceleration in a y-axis direction.
Figure 16:
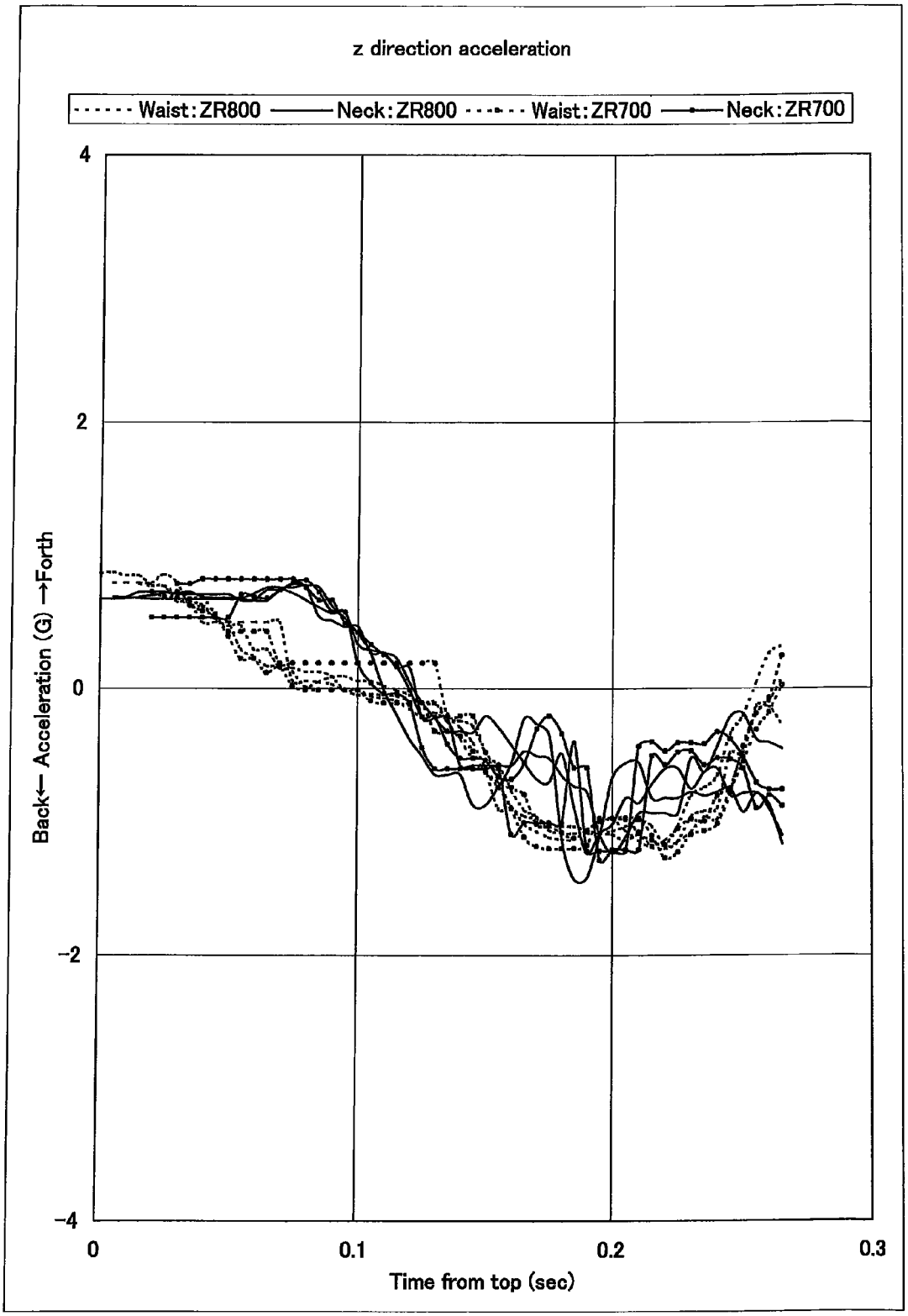
FIG. 16 shows another example of graph lines showing the measuring result of time-series data of acceleration in a z-axis direction.

Mr. A swung two kinds of golf clubs on the same measuring conditions as those of the example 1. FIGS. 14, 15, and 16 are [time-acceleration] graphs showing the measuring results. The items of two kinds of golf clubs are as follows. As a first golf club, trade name "SRIXONZR-800" (W#1, SV-3016) T-55 carbon shaft, flex "R") manufactured by SRI Sports Limited was used. As a second golf club, trade name "SRIXON ZR-700" (W#1, SV-3012) T-55 carbon shaft, flex "R") manufactured by SRI Sports Limited was used. Mr. A swung each of the clubs three times.

FIG. 14 is a graph of acceleration data in an x-axis direction. FIG. 15 is a graph of acceleration data in a y-axis direction. FIG. 16 is a graph of acceleration data in a z-axis direction. In these graphs, the broken lines show measured data based on the acceleration measuring device (the acceleration measuring device 41 of FIG. 2) attached to a waist. The solid lines show measured data based on the acceleration measuring device (acceleration measuring device 42 of FIG. 2) attached to a neck. Graph lines which are attached with black dots at equal intervals are data of "ZR-700". Graph lines which are not attached with the black dots are data of "ZR-800". For example, the various analyses described above based on these graphs can determine which of "ZR-700" and "ZR-800" adapts to Mr. A in comparison of "ZR-700" with "ZR-800".

Figure 17:
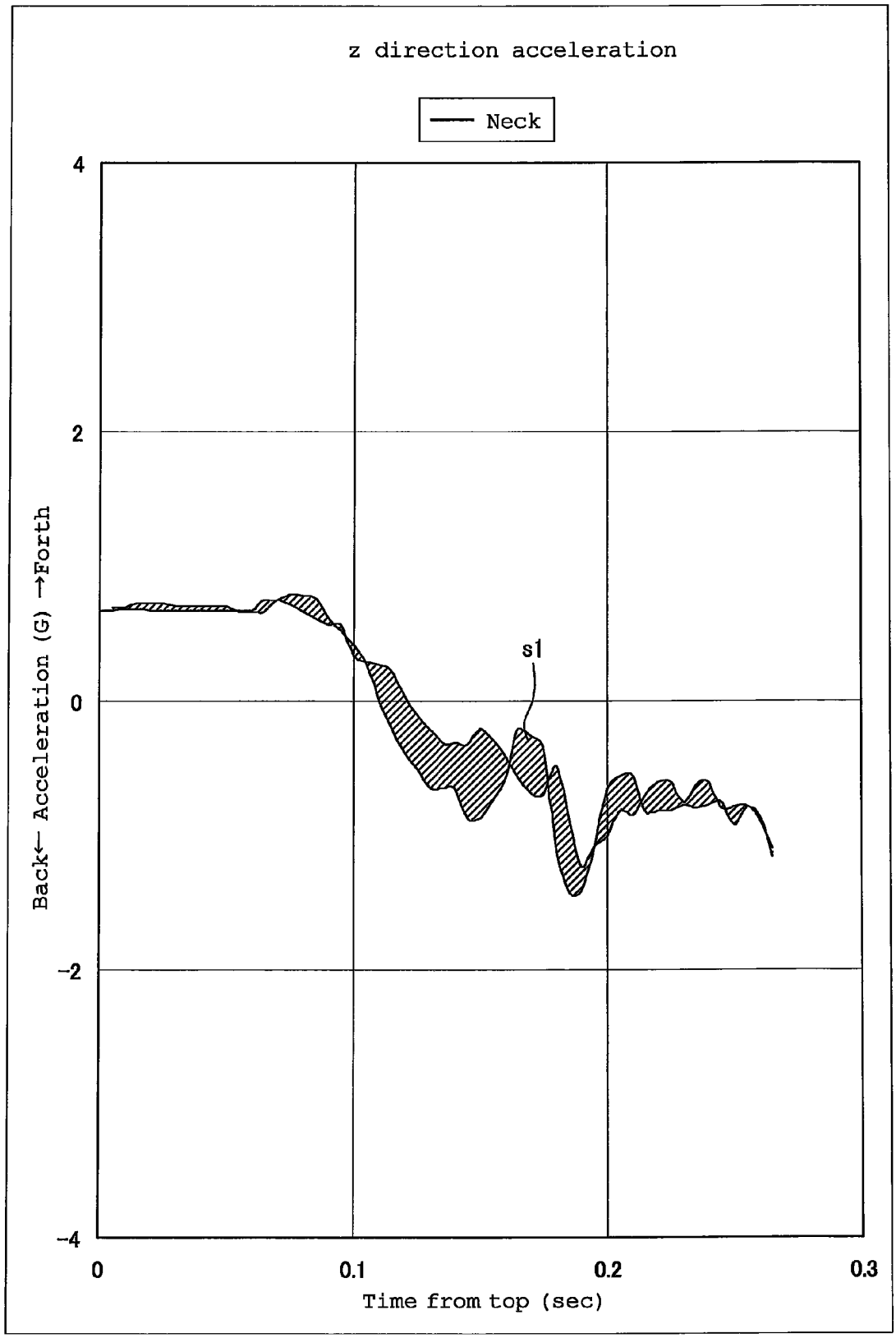
FIG. 17 shows an area s1 of a portion surrounded by a plurality of graph lines drawn by a plurality of swings.
Figure 18:
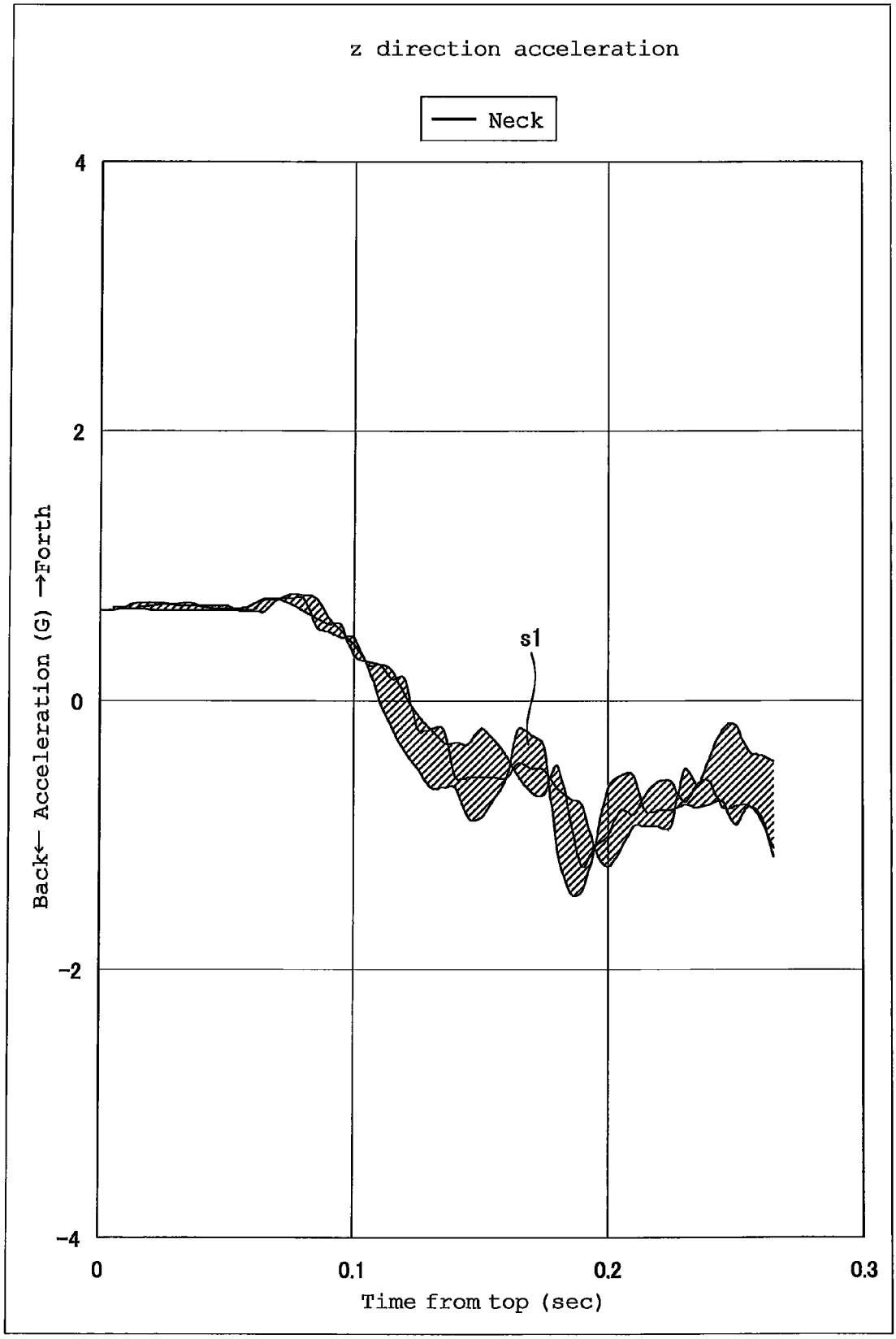
FIG. 18 shows another example of the area s1.

An example of specific analysis will be described by using the data of FIG. 10 as an example. In FIG. 17, an area s1 surrounded by a graph line of a first swing and a graph line of a second swing for the acceleration in the neck is shown by hatching. It is believed that the smaller this area s1 is, the higher the repeatability of the swing is. In FIG. 18, an area s1 surrounded by three graph lines obtained by three swings is shown by hatching. It is believed that the smaller this area s1 is, the higher the repeatability of the swing is. When the number of the swings is increased, the reliability of the determination by the area s1 can be enhanced.

Figure 19:
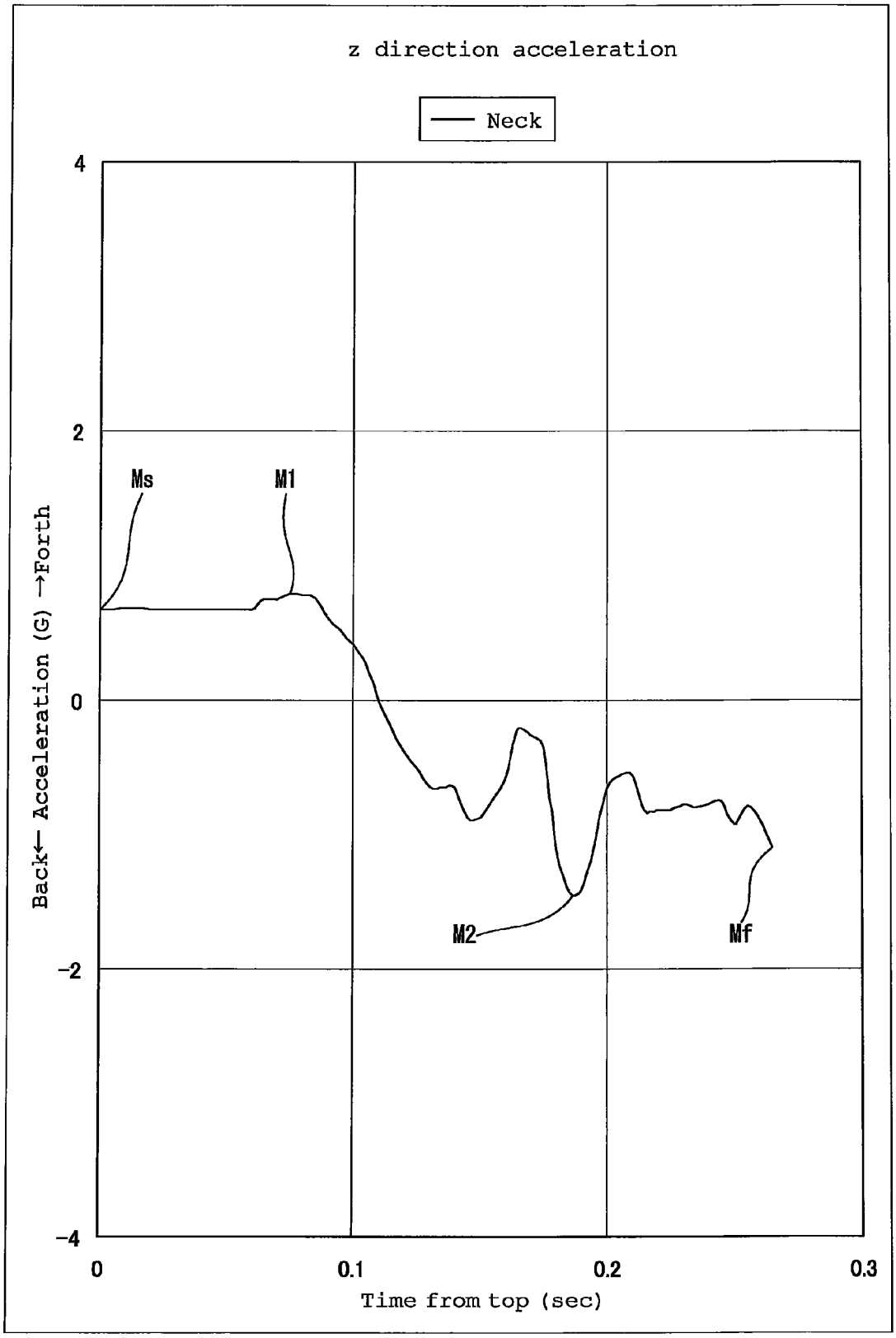
FIG. 19 is a graph for describing an example of a data analysis method.

FIG. 19 shows one of the three graph lines of the "neck" in FIG. 10. One example of another specific analysis will be described by using this graph line as example. In the graph line of FIG. 19, reference numeral M1 represents a point at which acceleration is the maximum. Reference numeral M2 represents a point at which acceleration is the minimum. Reference numeral Ms represents a point when measurement is started. Reference numeral Mf represents a point when measurement is ended. For example, a difference between acceleration Amax at M1 and acceleration Amin at M2 (Amax−Amin) can be an important indication for determining the type and repeatability or the like of the swing. A time Td1 from a time of M1 to a time of M2 can be an important indication for determining the type and repeatability or the like of the swing. A difference between acceleration As at Ms and acceleration Af at Mf (As−Af), and an absolute value |As−Af| thereof can be an important indication for determining the type, repeatability, and the like of the swing.

Figure 20:
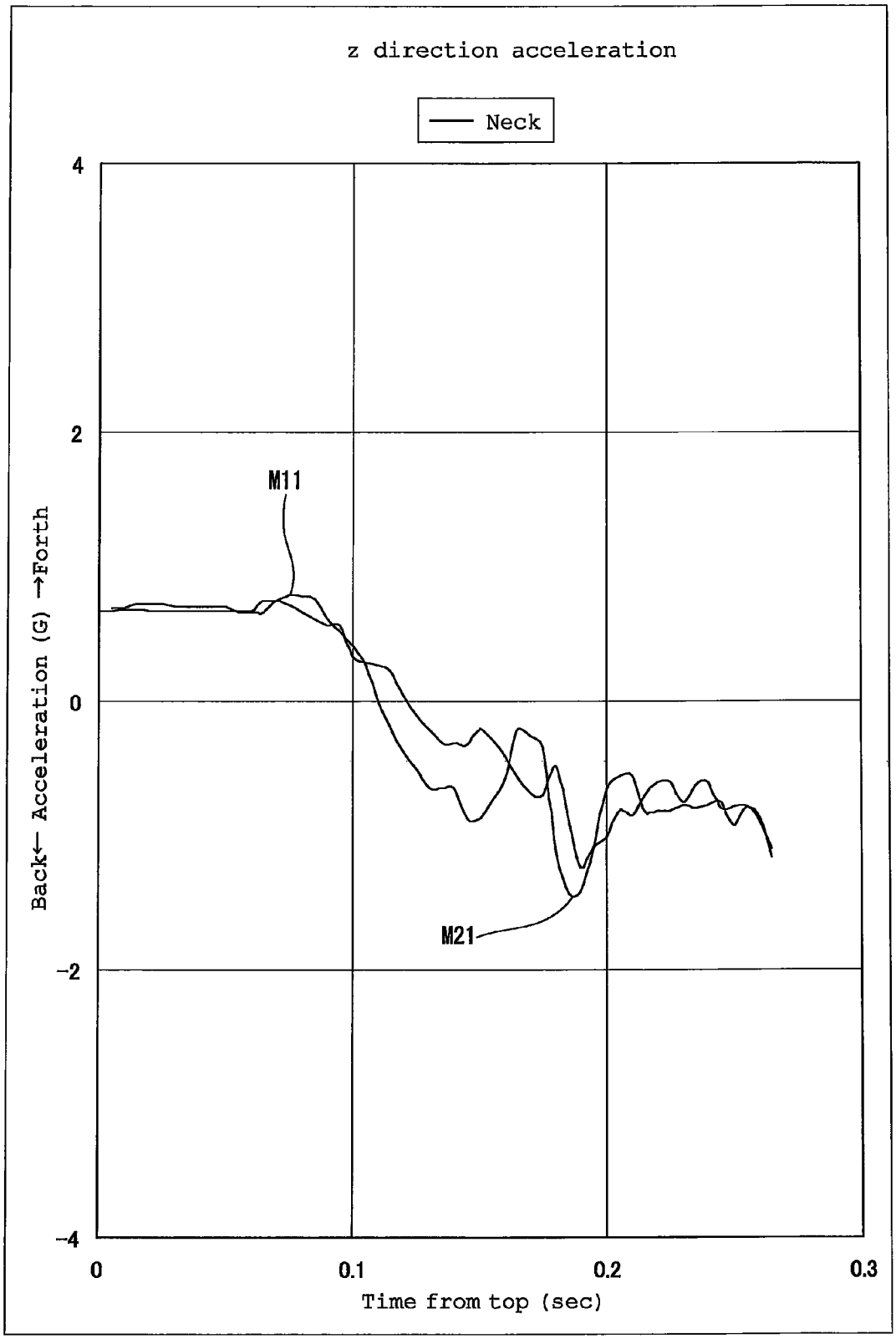
FIG. 20 is a graph for describing another example of data analysis.

FIG. 20 shows two of the three graph lines of the "neck" in FIG. 10. One example of another specific analysis will be described by using this graph line as example. In the plurality (two) of graph lines of FIG. 20, reference numeral M11 represents a point at which acceleration is the maximum. In the plurality (two) of graph lines, reference numeral M21 represents a point at which acceleration is the minimum. For example, a difference between acceleration Amax at M11 and acceleration Amin at M21 (Amax−Amin) can be an important indication for determining the type and repeatability or the like of the swing. A time Td1 from a time of M11 to a time of M21 can be an important indication for determining the type, repeatability, and the like of the swing. As shown in this example, the analysis may be applied to two measurements. All the analysis items described above may be applied to one measurement, and may be applied to the plurality of measurements. The analysis accuracy can be enhanced by the plurality of measurements of the object to be analyzed.

Example 3

Mr. A' swing (swing different from that of the example 1) was measured on the same measuring conditions as those of the example 1. The swing was measured from a top-of-swing to an impact. FIGS. 21 to 30 are graphs showing this measuring result. As a golf club, trade name "THE XXIO" (W#1, MP500 carbon shaft, flex "R") manufactured by SRI Sports Limited was used.

Figure 21:
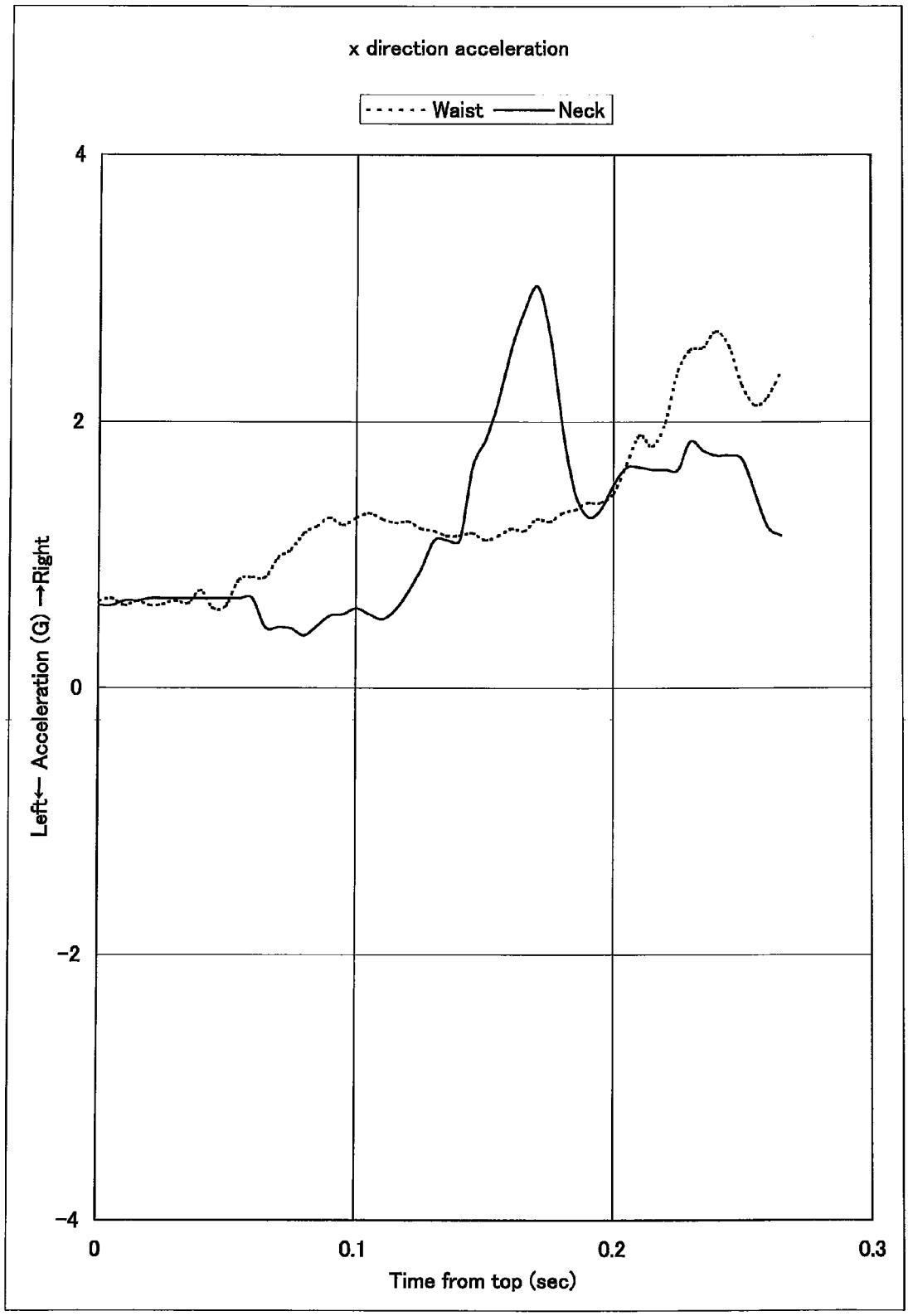
FIG. 21 is a graph showing another example of data analysis.
Figure 22:
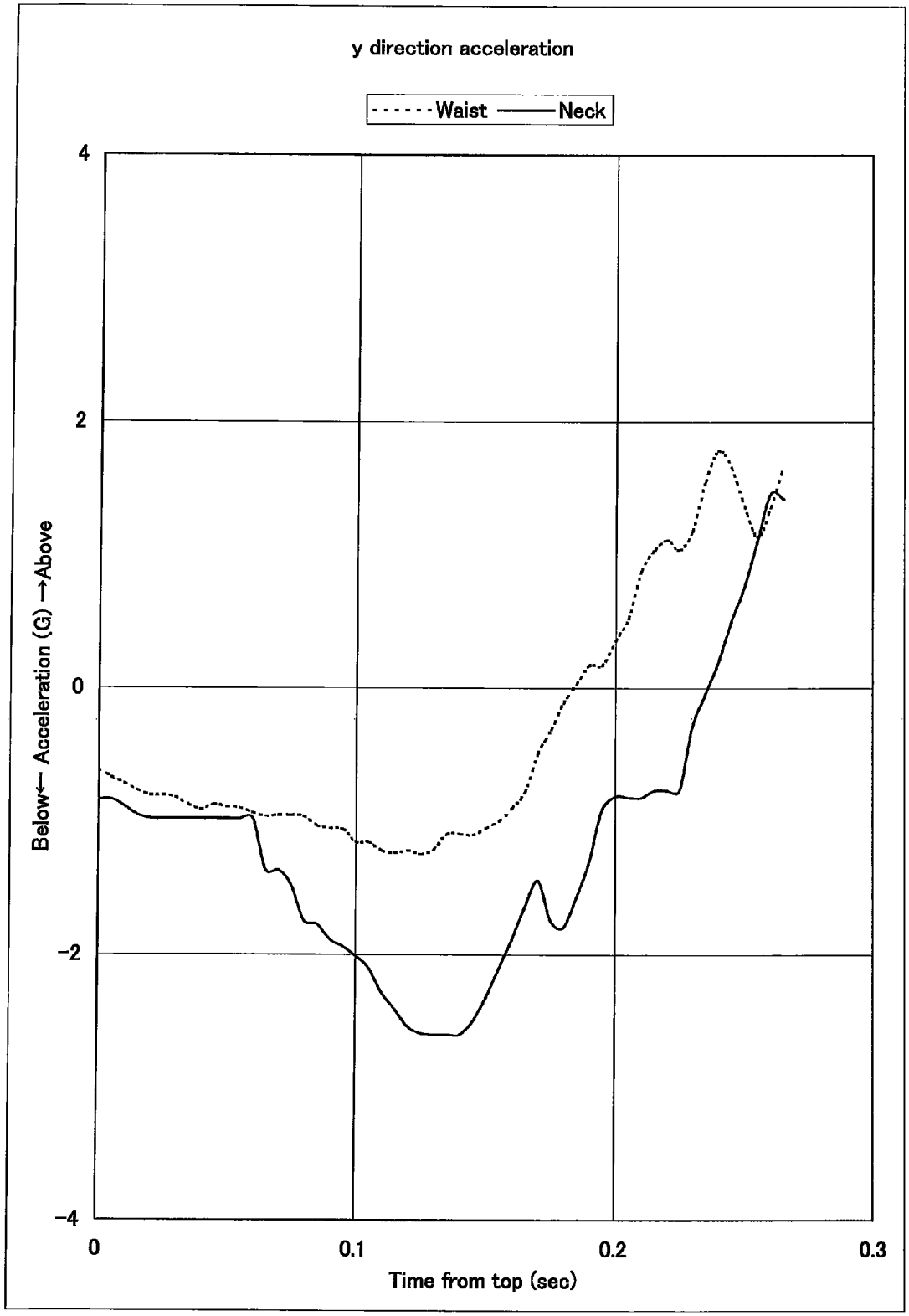
FIG. 22 is a graph showing another example of data analysis.
Figure 23:
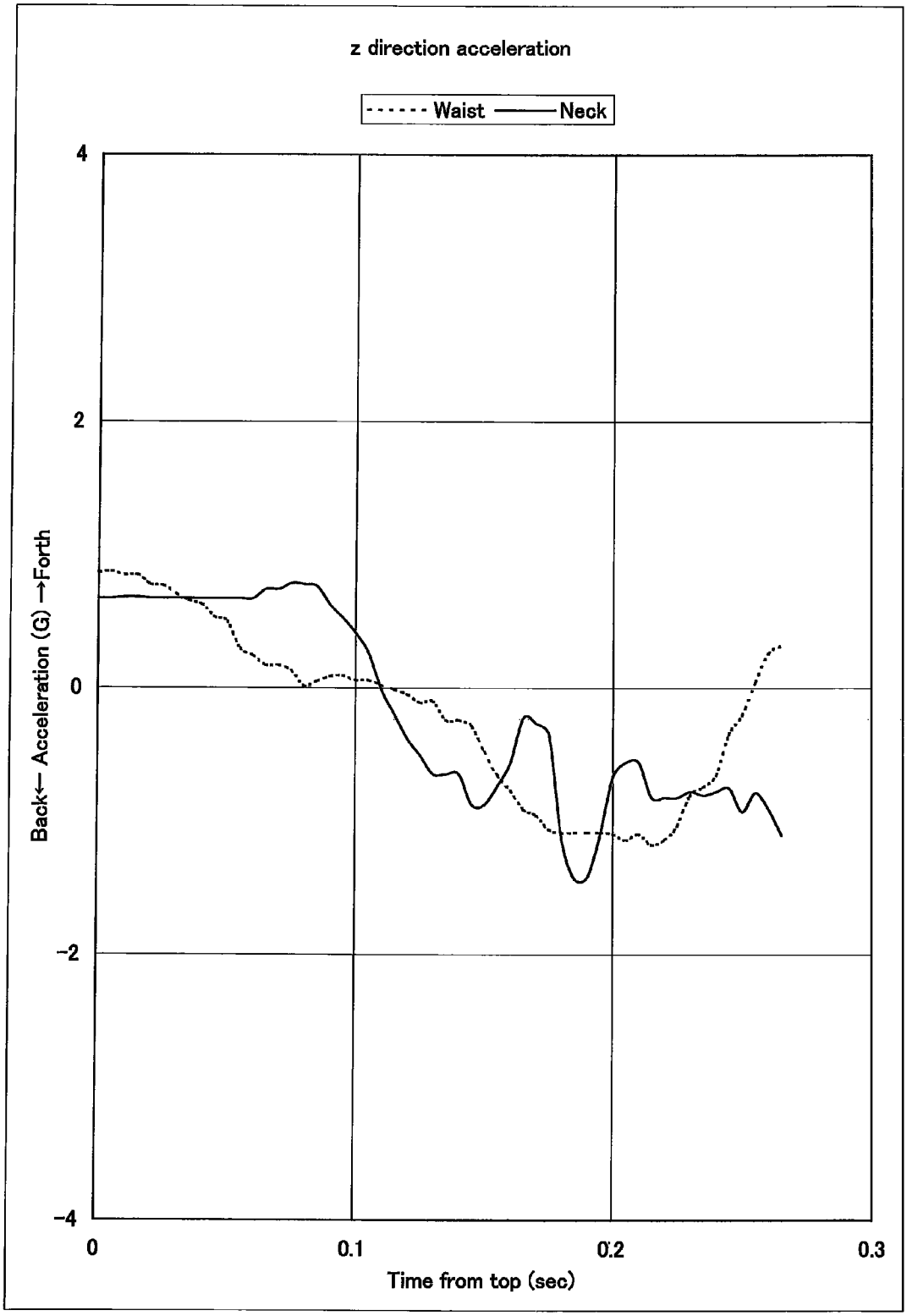
FIG. 23 is a graph showing another example of data analysis.

FIGS. 21, 22 and 23 are [time-acceleration] graphs. FIG. 21 shows graph lines of acceleration data in an x-axis direction. FIG. 22 shows graph lines of acceleration data in a y-axis direction. FIG. 23 shows graph lines of acceleration data in a z-axis direction. Among these graph lines, the broken lines show measured data based on the acceleration measuring device (the acceleration measuring device 41 of FIG. 2) attached to a waist. The solid lines show measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 24:
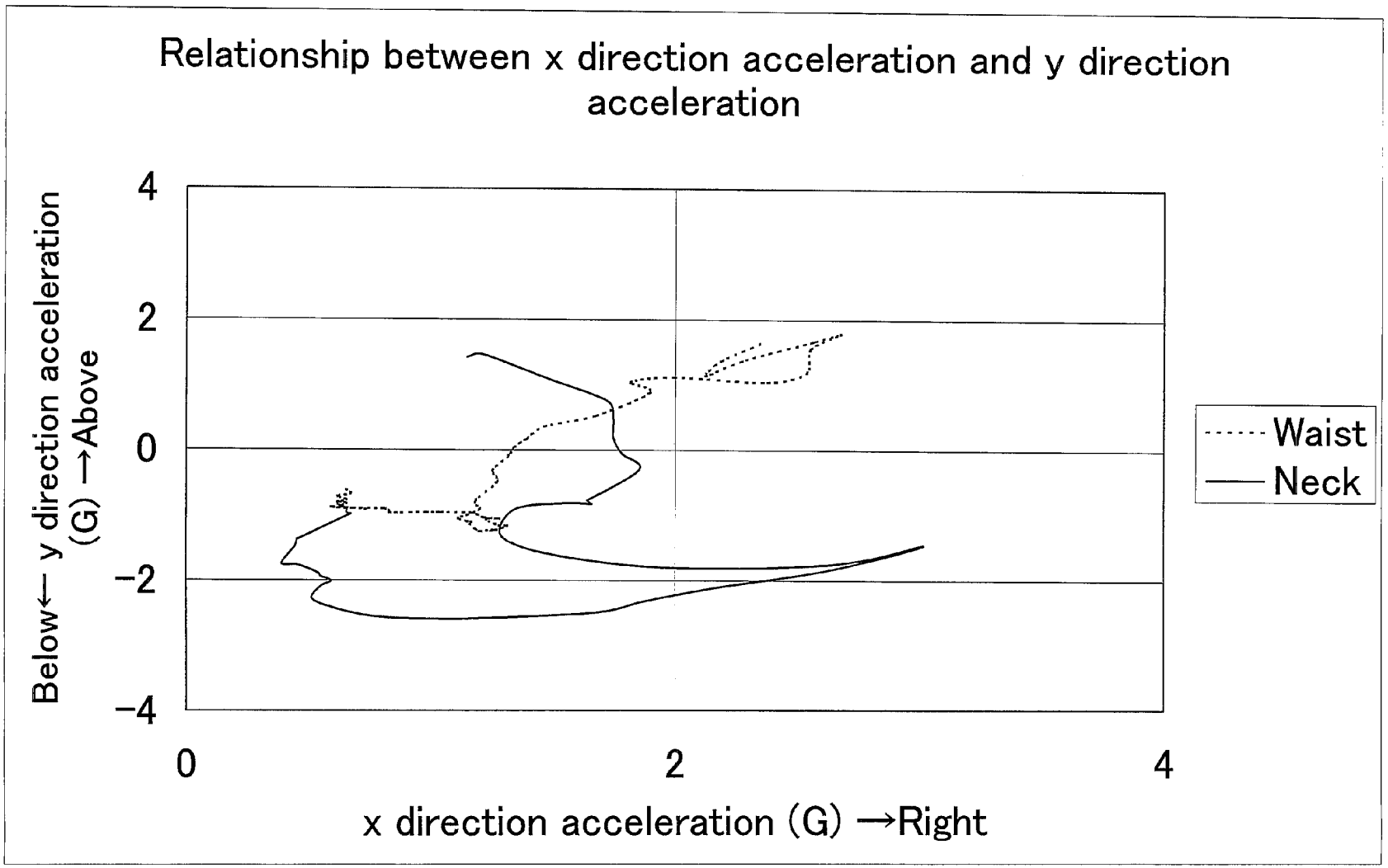
FIG. 24 is a graph showing another example of data analysis.

FIG. 24 is a graph with a horizontal axis set to acceleration in an x-axis direction and a vertical axis set to acceleration in a y-axis direction. In these graph lines, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 25:
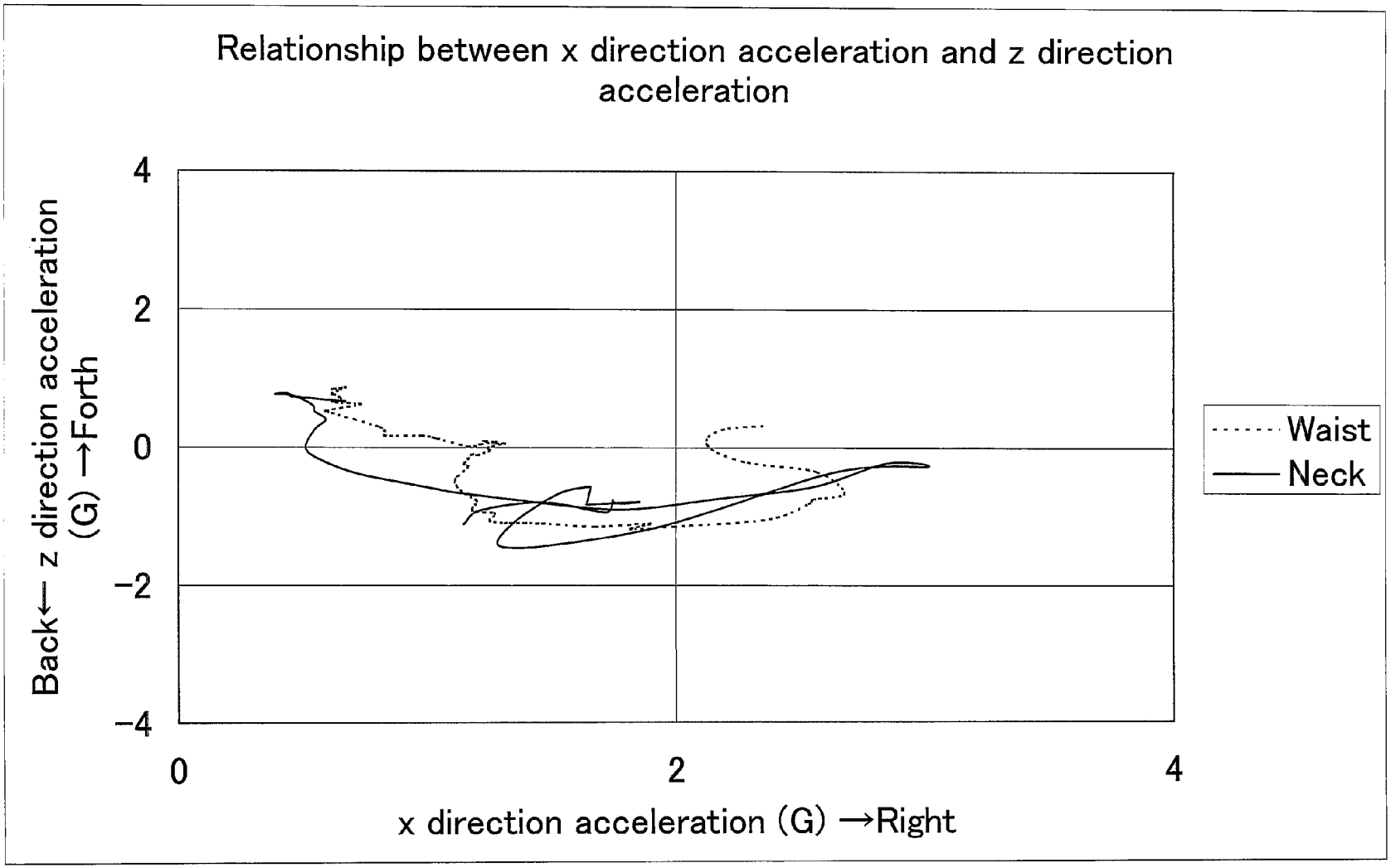
FIG. 25 is a graph showing another example of data analysis.

FIG. 25 is a graph with a horizontal axis set to acceleration in an x-axis direction and a vertical axis set to acceleration in a z-axis direction. In these graph lines, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 26:
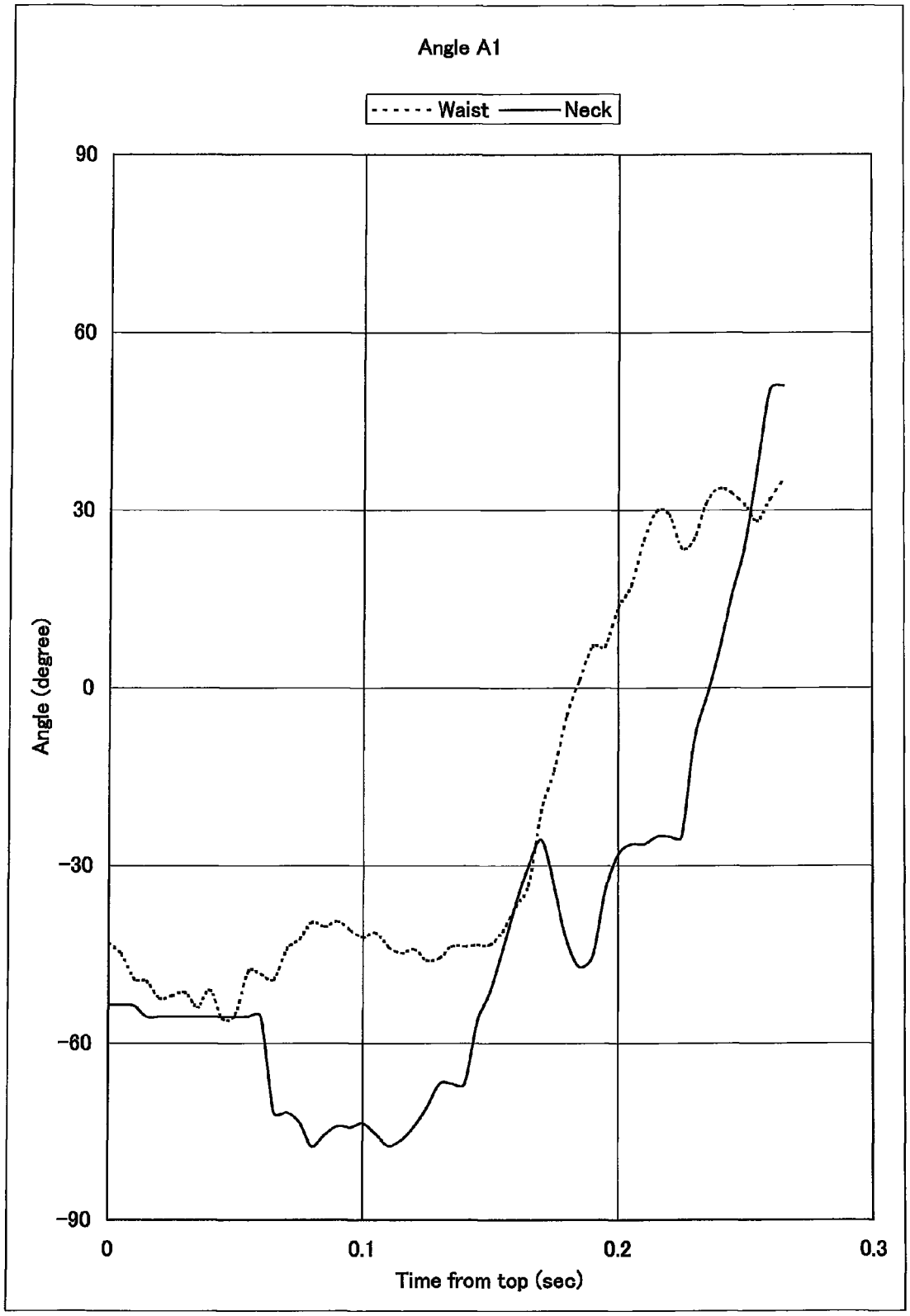
FIG. 26 is a graph showing another example of data analysis.

FIG. 26 is a graph with a horizontal axis showing a time from a top-of-swing and a vertical axis showing an angle A1 (degree) between an x-axis direction and a vector (x, y). The vector (x, y) is the vector sum of acceleration vector in the x-axis direction and acceleration vector in a y-axis direction. This angle A1 is calculated by the following formula.

$$A1=\arctan(y/x)$$

In FIG. 26, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this angle A1. The graph line of this angle A1 may be further analyzed. As described above, this angle A1 and this graph line can be analyzed variously.

Figure 27:
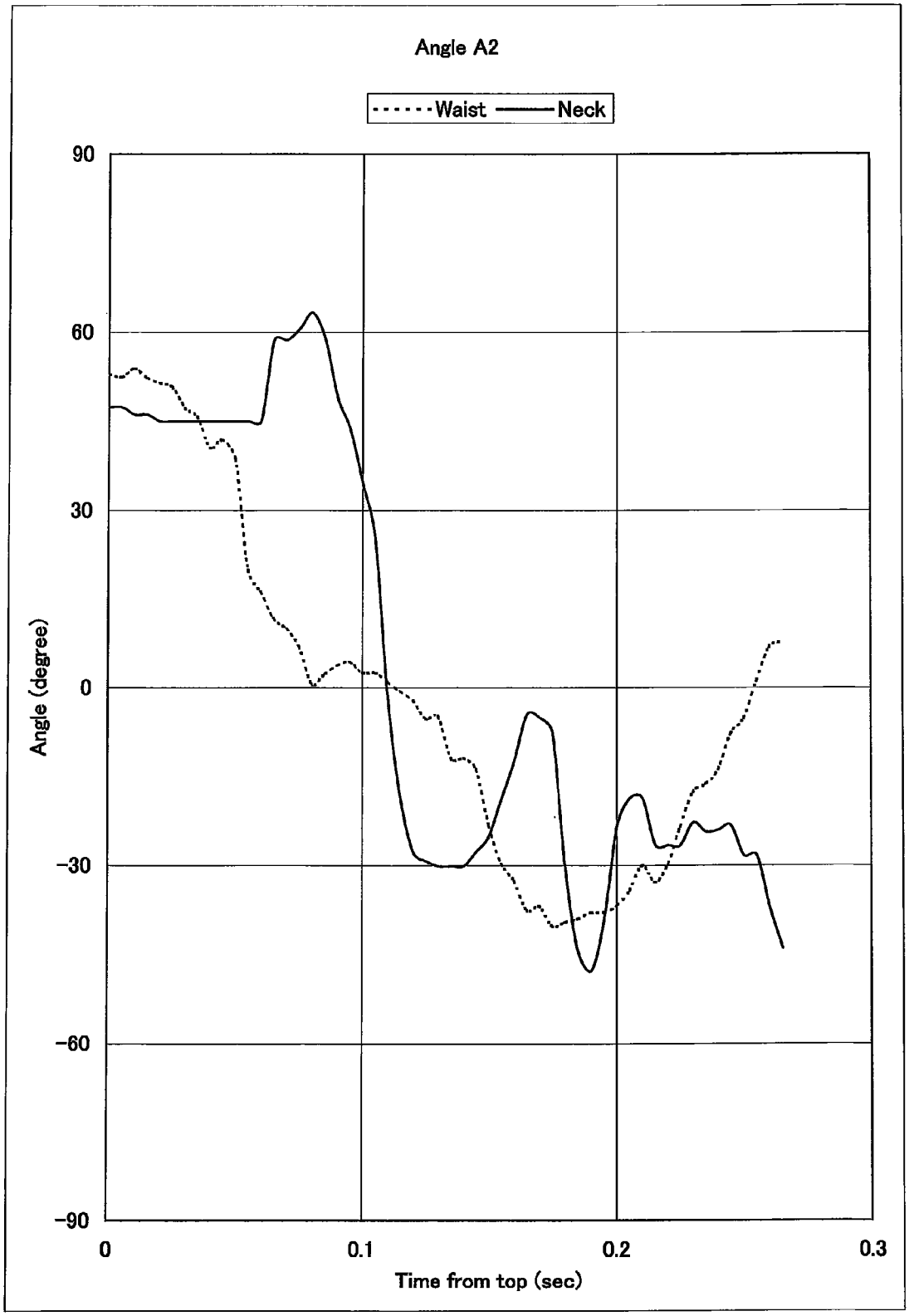
FIG. 27 is a graph showing another example of data analysis.

FIG. 27 is a graph with a horizontal axis showing the time from a top-of-swing and a vertical axis showing an angle A2 (degree) between an x-axis direction and a vector (x, z). The vector (x, z) is the vector sum of acceleration vector in the x-axis direction and acceleration vector in a z-axis direction. This angle A2 is calculated by the following formula.

$$A2=\arctan(z/x)$$

In FIG. 27, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this angle A2. The graph line of this angle A2 may be further analyzed. As described above, this angle A2 and this graph line can be analyzed variously.

Figure 28:
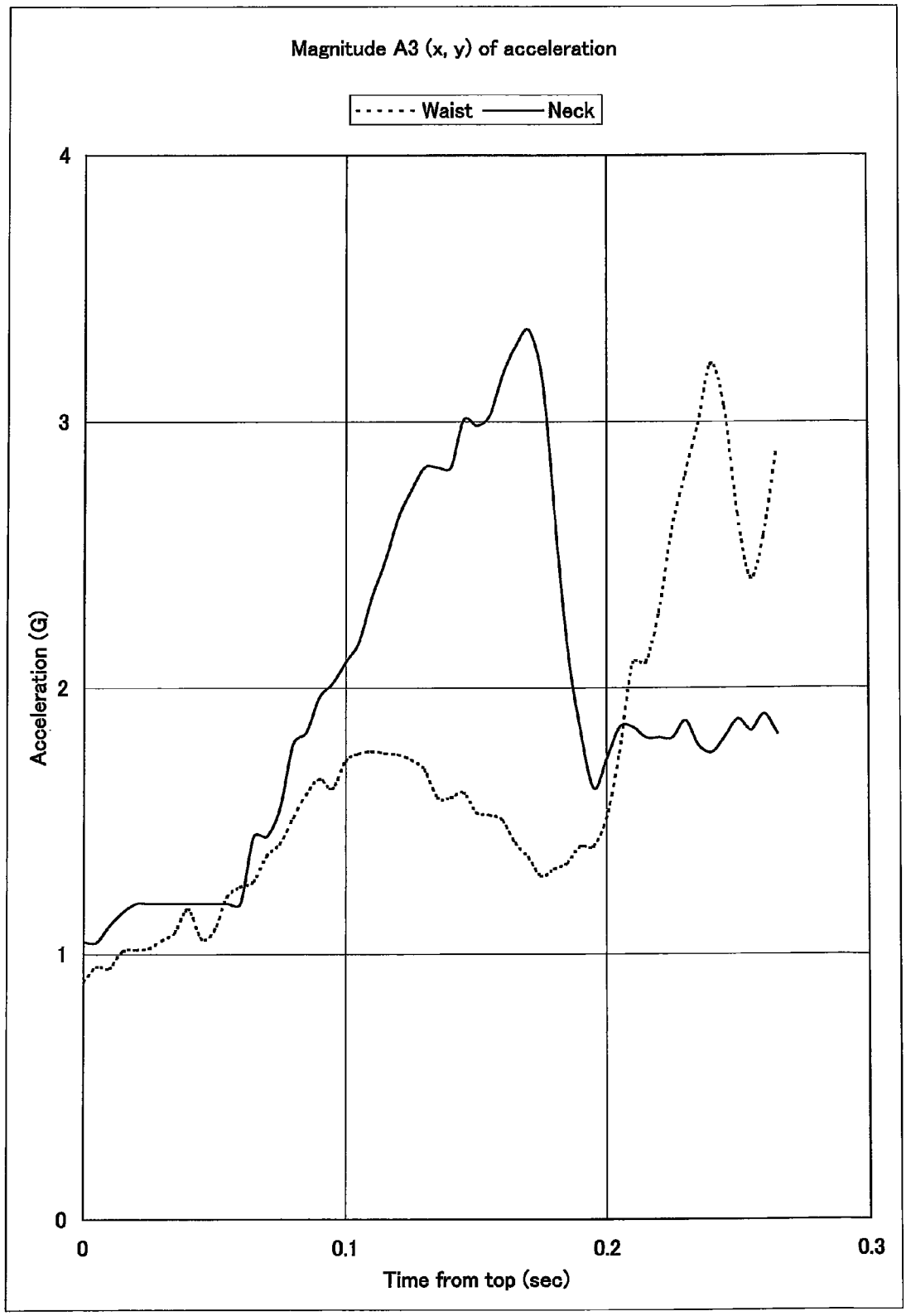
FIG. 28 is a graph showing another example of data analysis.

FIG. 28 is a graph with a horizontal axis showing a time from a top-of-swing and a vertical axis showing the magnitude A3 of the vector (x, y). When the value of acceleration in an x-axis direction is x and the value of acceleration in a y-axis direction is y, this magnitude A3 is calculated by the following formula.

$$A3=(x^2+y^2)^{1/2}$$

In FIG. 28, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A3. The graph line of this value A3 may be further analyzed. As described above, this value A3 and this graph line can be analyzed variously.

Figure 29:
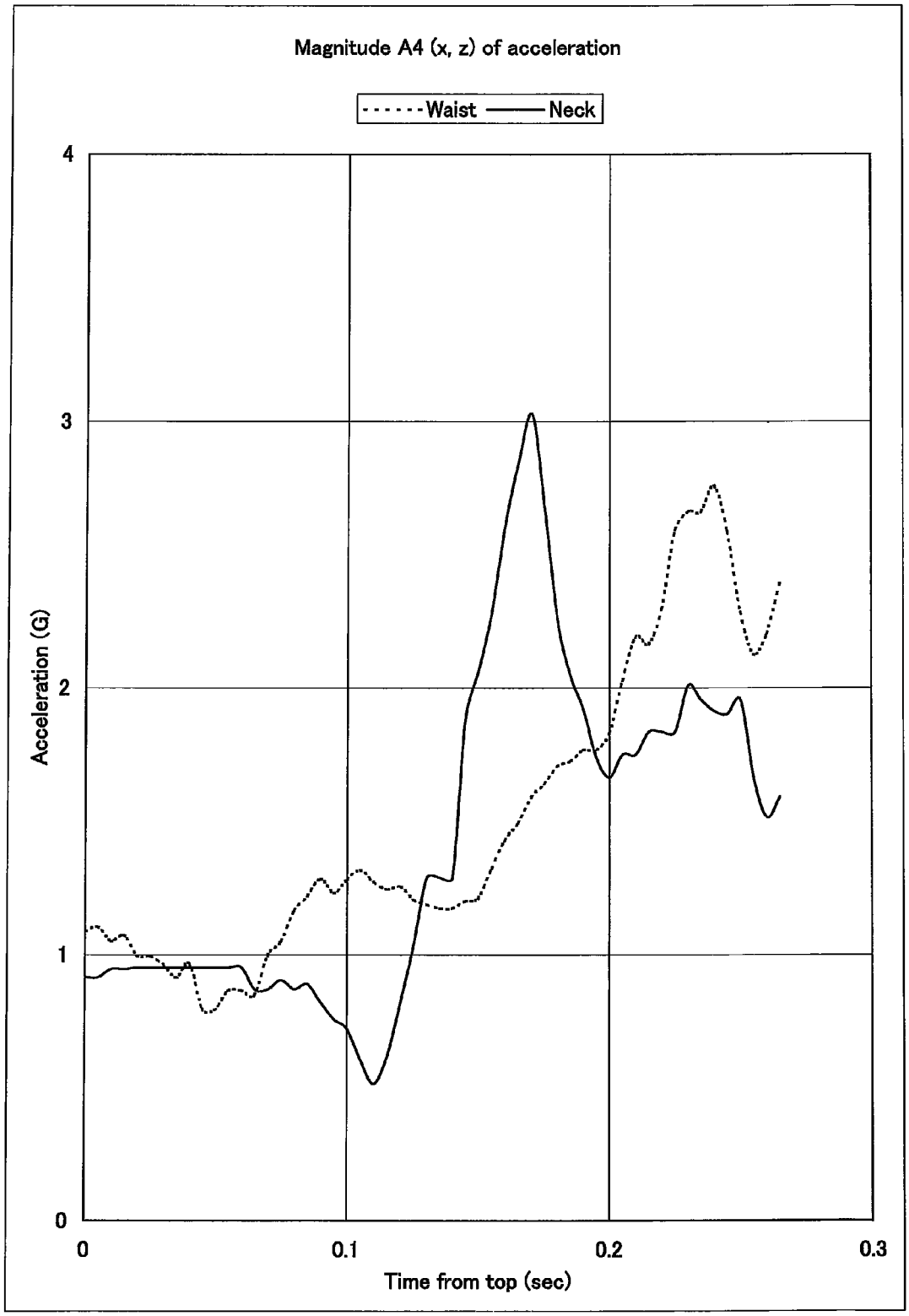
FIG. 29 is a graph showing another example of data analysis.

FIG. 29 is a graph with a horizontal axis showing a time from a top-of-swing and a vertical axis showing the magnitude A4 of the vector (x, z). When the value of acceleration in an x-axis direction is x and the value of acceleration in a z-axis direction is z, this magnitude A4 is calculated by the following formula.

$$A4=(x^2+z^2)^{1/2}$$

In FIG. 29, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A4. The graph line of this value A4 may be further analyzed. As described above, this value A4 and this graph line can be analyzed variously.

Figure 30:
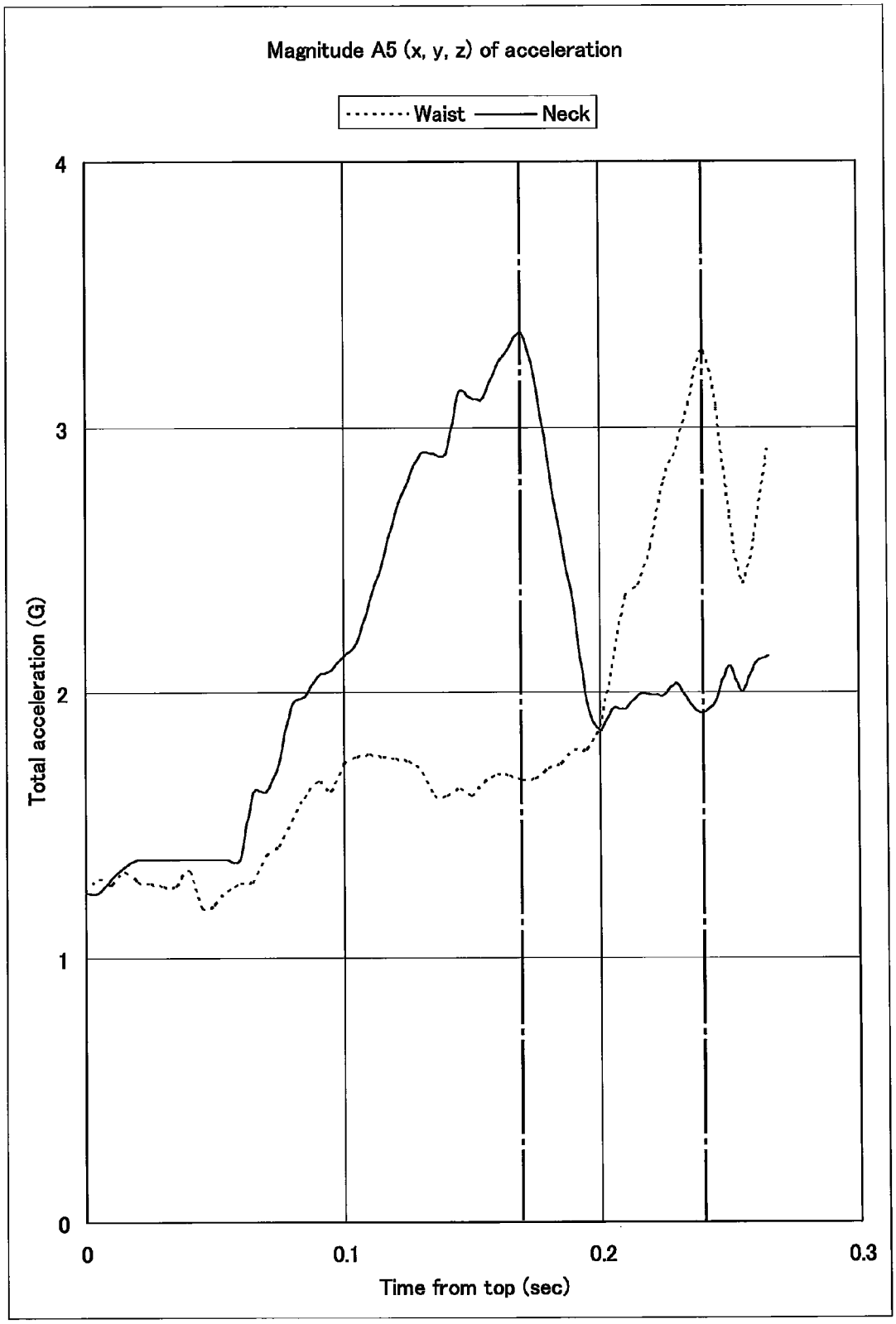
FIG. 30 is a graph showing another example of data analysis.

FIG. 30 is a graph with a horizontal axis showing a time from a top-of-swing and a vertical axis showing the magnitude A5 of the vector (x, y, z). When the value of acceleration in an x-axis direction is x; the value of acceleration in a y-axis direction is y; and the value of acceleration in a z-axis direction is z, this magnitude A5 is calculated by the following formula. This value A5 is the magnitude of the acceleration itself which acts on an accelerometer.

$$A5=(x^2+y^2+z^2)^{1/2}$$

In FIG. 30, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A5. The graph line of this value A5 may be further analyzed. As described above, this value A5 and this graph line can be analyzed variously.

Example 4

A Mr. B' swing (swing different from that of the example 1) was measured on the same measuring conditions as those of the example 1. The swing was measured from a top-of-swing to an impact. FIGS. 31 to 40 are graphs showing this measuring result. As a golf club, trade name "THE XXIO" (W#1, MP500 carbon shaft, flex "R") manufactured by SRI Sports Limited was used.

Figure 31:
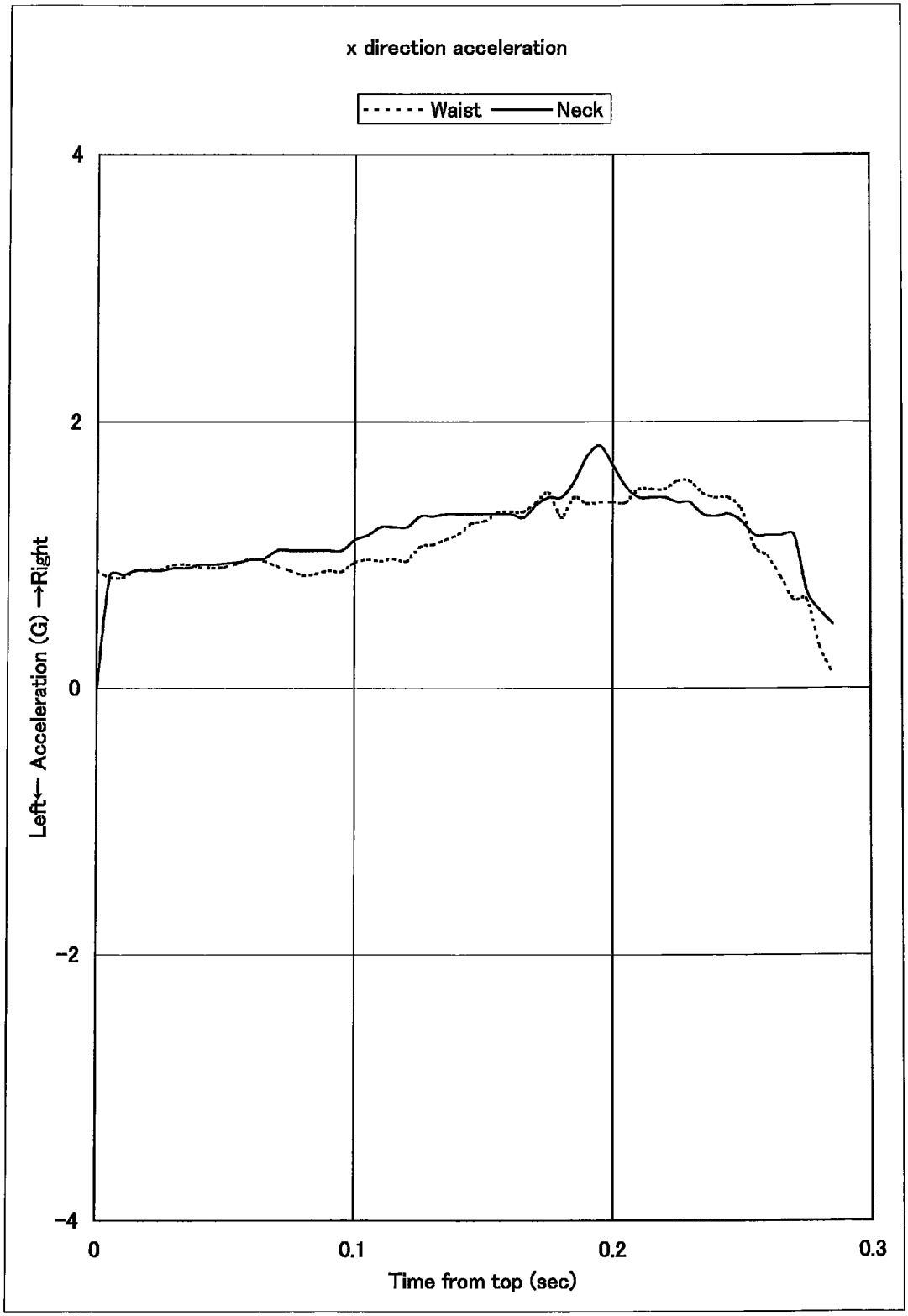
FIG. 31 is a graph showing another example of data analysis.
Figure 32:
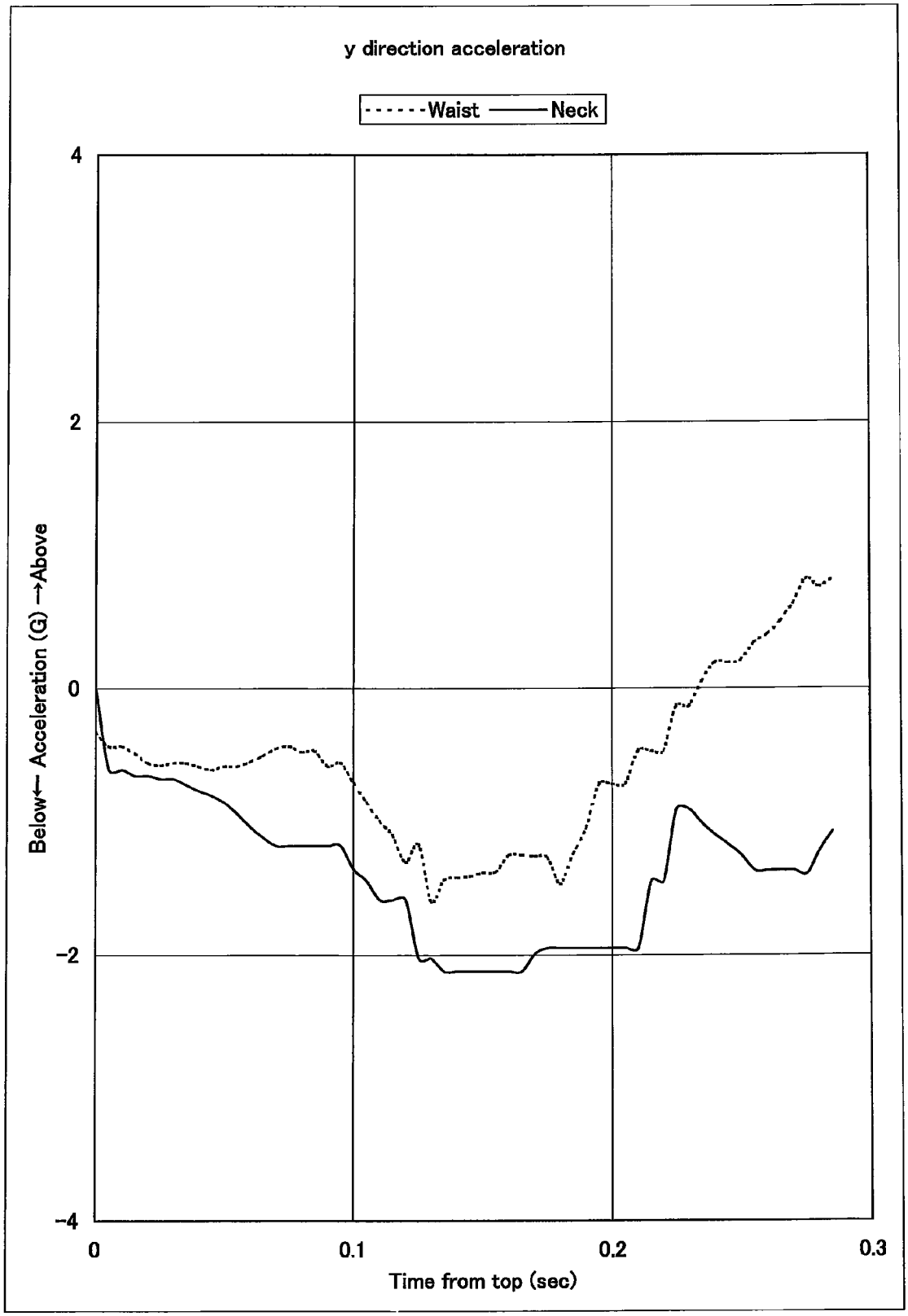
FIG. 32 is a graph showing another example of data analysis.
Figure 33:
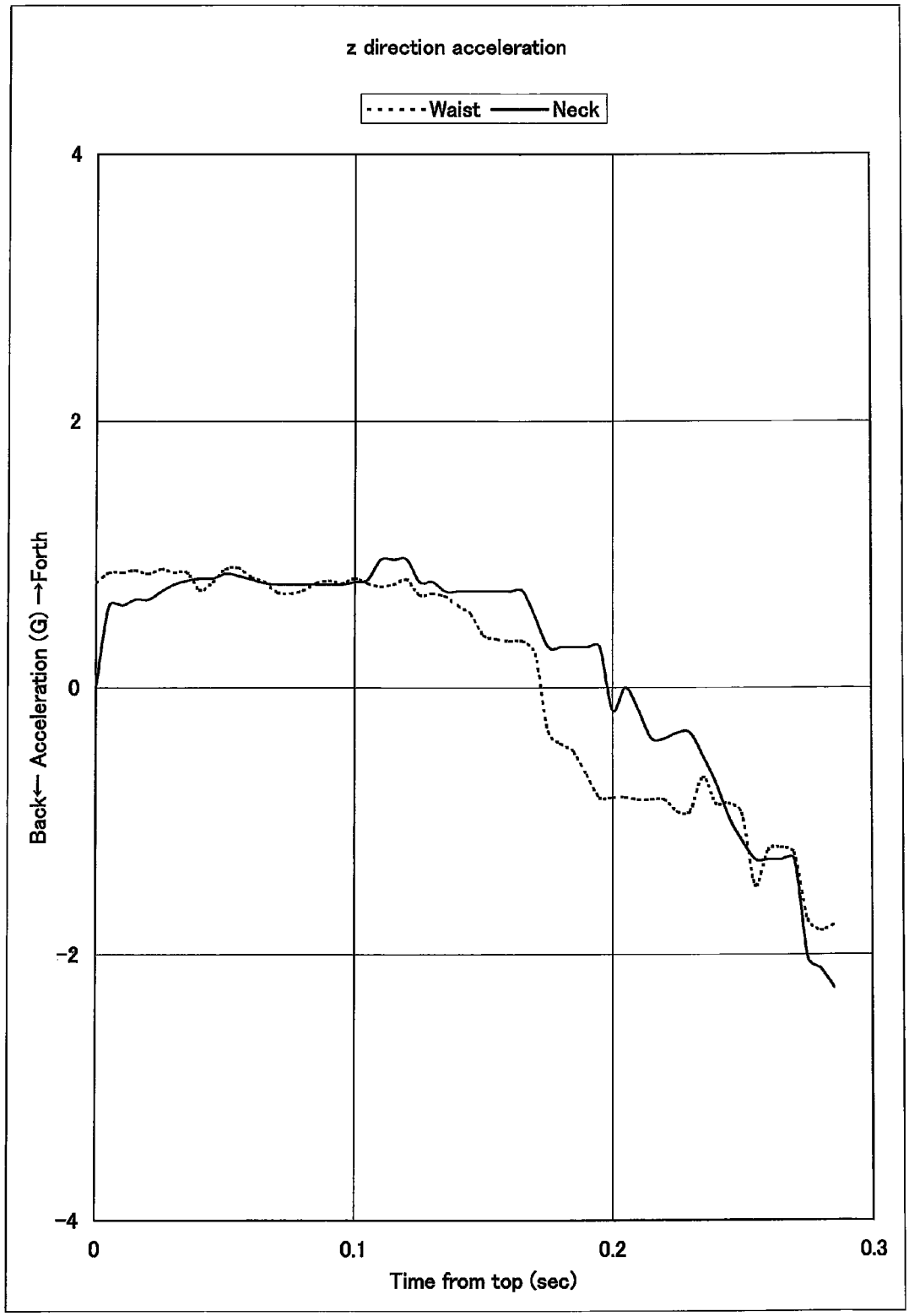
FIG. 33 is a graph showing another example of data analysis.

FIGS. 31, 32, and 33 are [time-acceleration] graphs. FIG. 31 shows graph lines of acceleration data in an x-axis direction. FIG. 32 shows graph lines of acceleration data in a y-axis direction. FIG. 33 shows graph lines of acceleration data in a z-axis direction. Among these graph lines, the broken lines show measured data based on the acceleration measuring device (the acceleration measuring device 41 of FIG. 2) attached to a waist. The solid lines show measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 34:
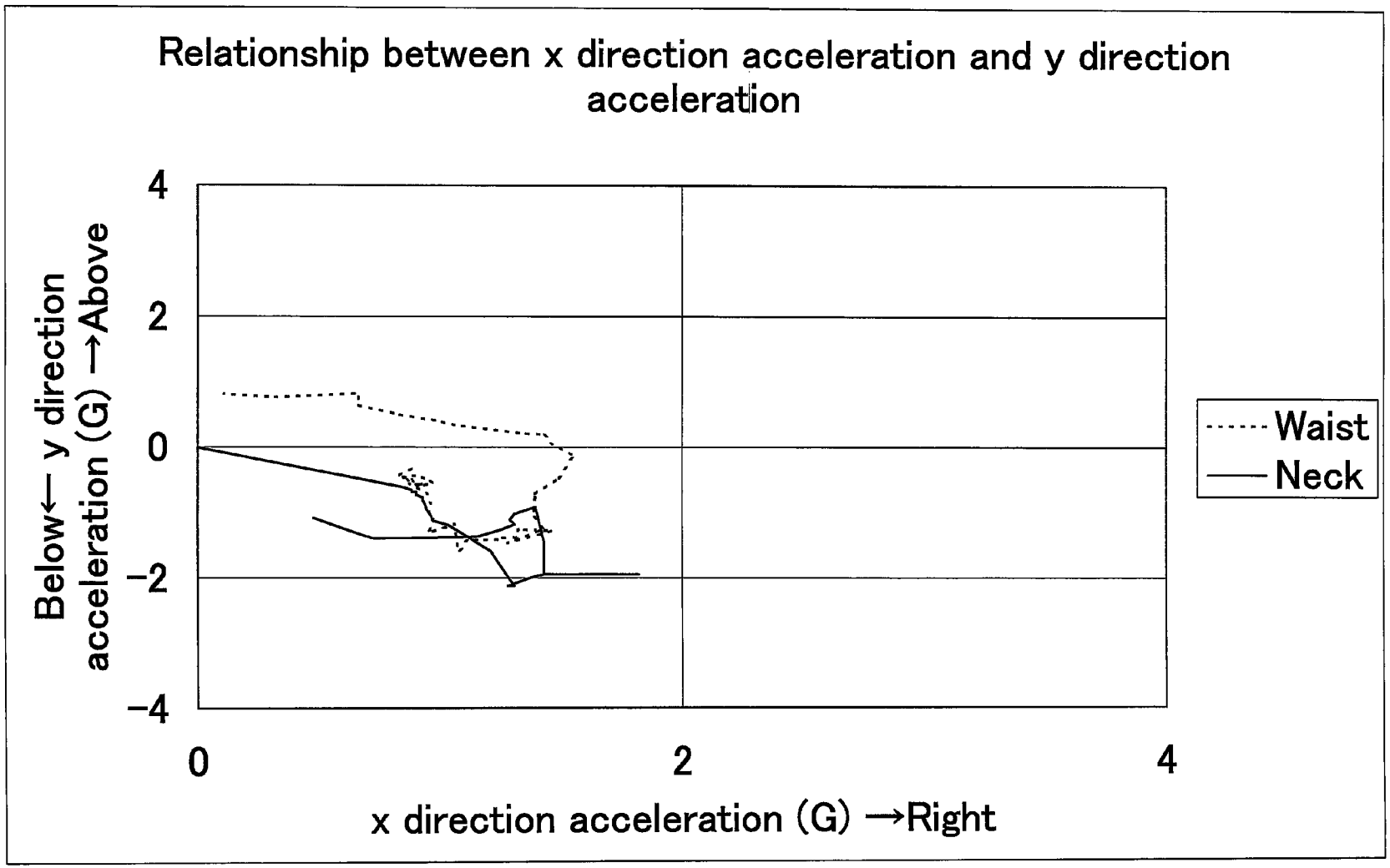
FIG. 34 is a graph showing another example of data analysis.

FIG. 34 is a graph with a horizontal axis set to acceleration in an x-axis direction and a vertical axis set to acceleration in a y-axis direction. In these graph lines, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 35:
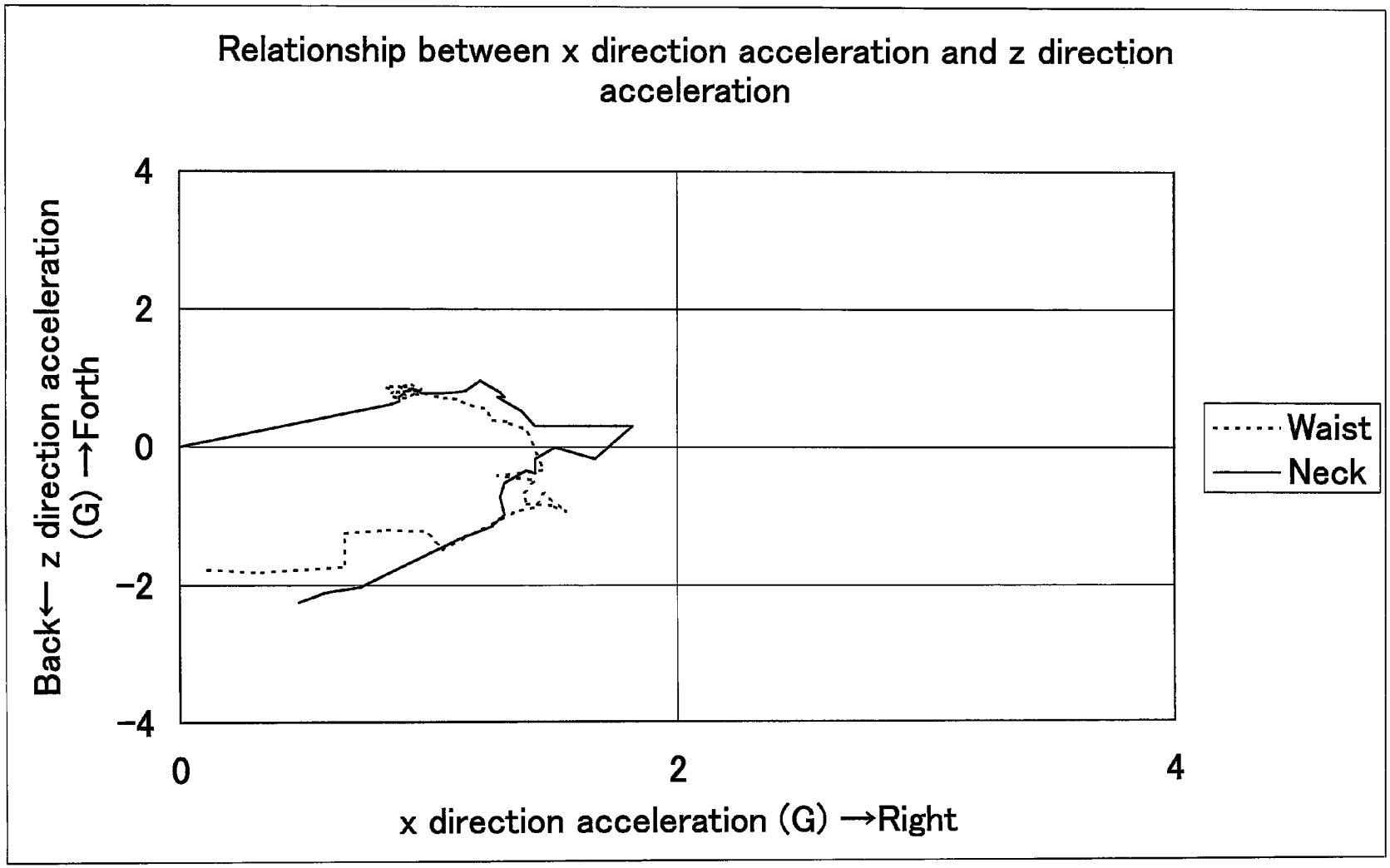
FIG. 35 is a graph showing another example of data analysis.

FIG. 35 is a graph with a horizontal axis set to acceleration in an x-axis direction and a vertical axis set to acceleration in a z-axis direction. In these graph lines, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. Each of the graphs has features in waveforms, the local maximum value, the local minimum value, the maximum value, the minimum value, a time of the local maximum value, a time of the local minimum value, a time of the maximum value, a time of the minimum value, or the like. As described above, the data of each of the graphs can be analyzed variously.

Figure 36:
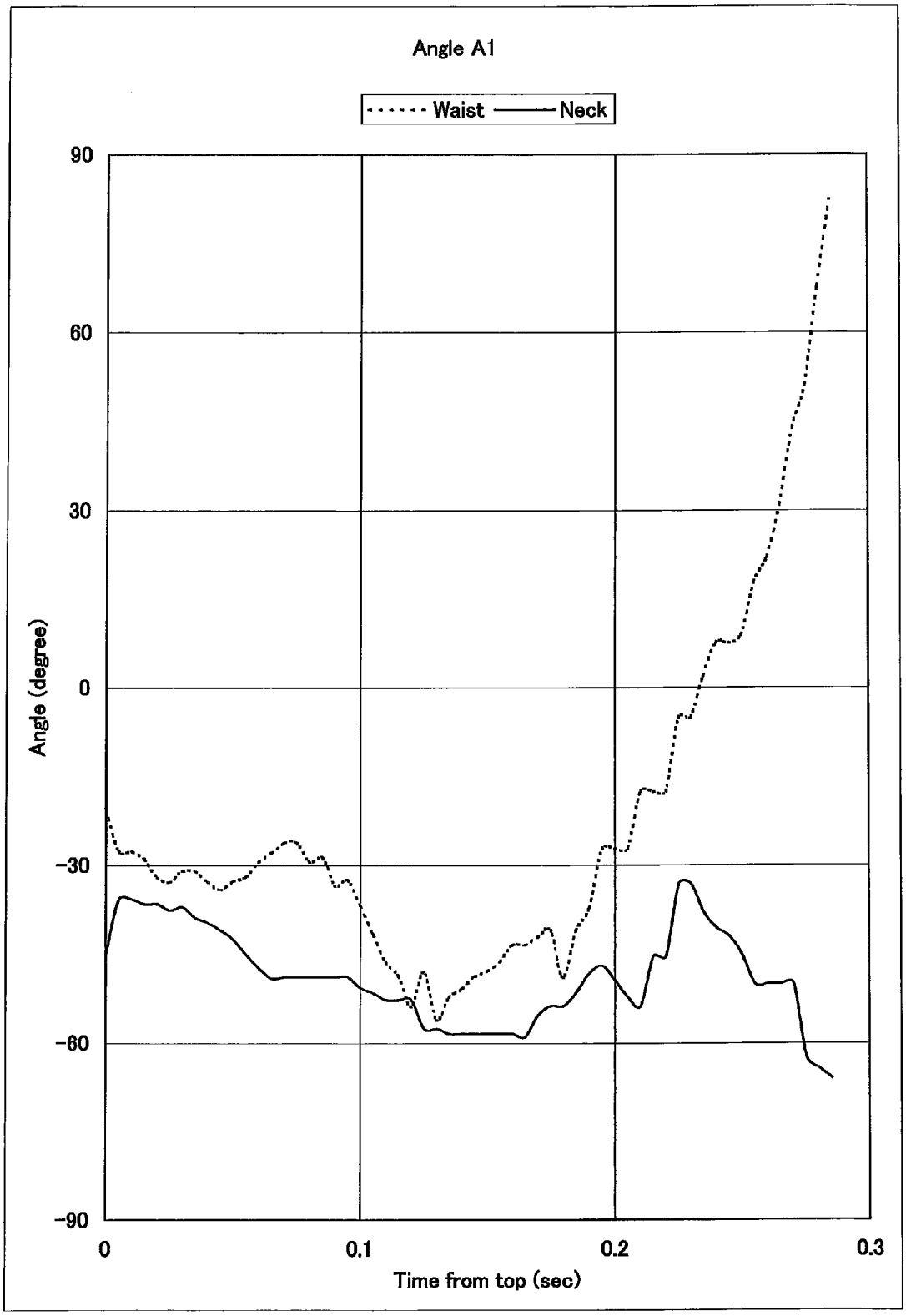
FIG. 36 is a graph showing another example of data analysis.

FIG. 36 is a graph with a horizontal axis showing a time from a top-of-swing and a vertical axis showing an angle A1 (degree) between an x-axis direction and a vector (x, y). The vector (x, y) is the vector sum of acceleration vector in the x-axis direction and acceleration vector in a y-axis direction. The calculating formula of this angle A1 is described above.

In FIG. 36, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this angle A1. The graph line of this angle A1 may be further analyzed. As described above, this angle A1 and this graph line can be analyzed variously.

Figure 37:
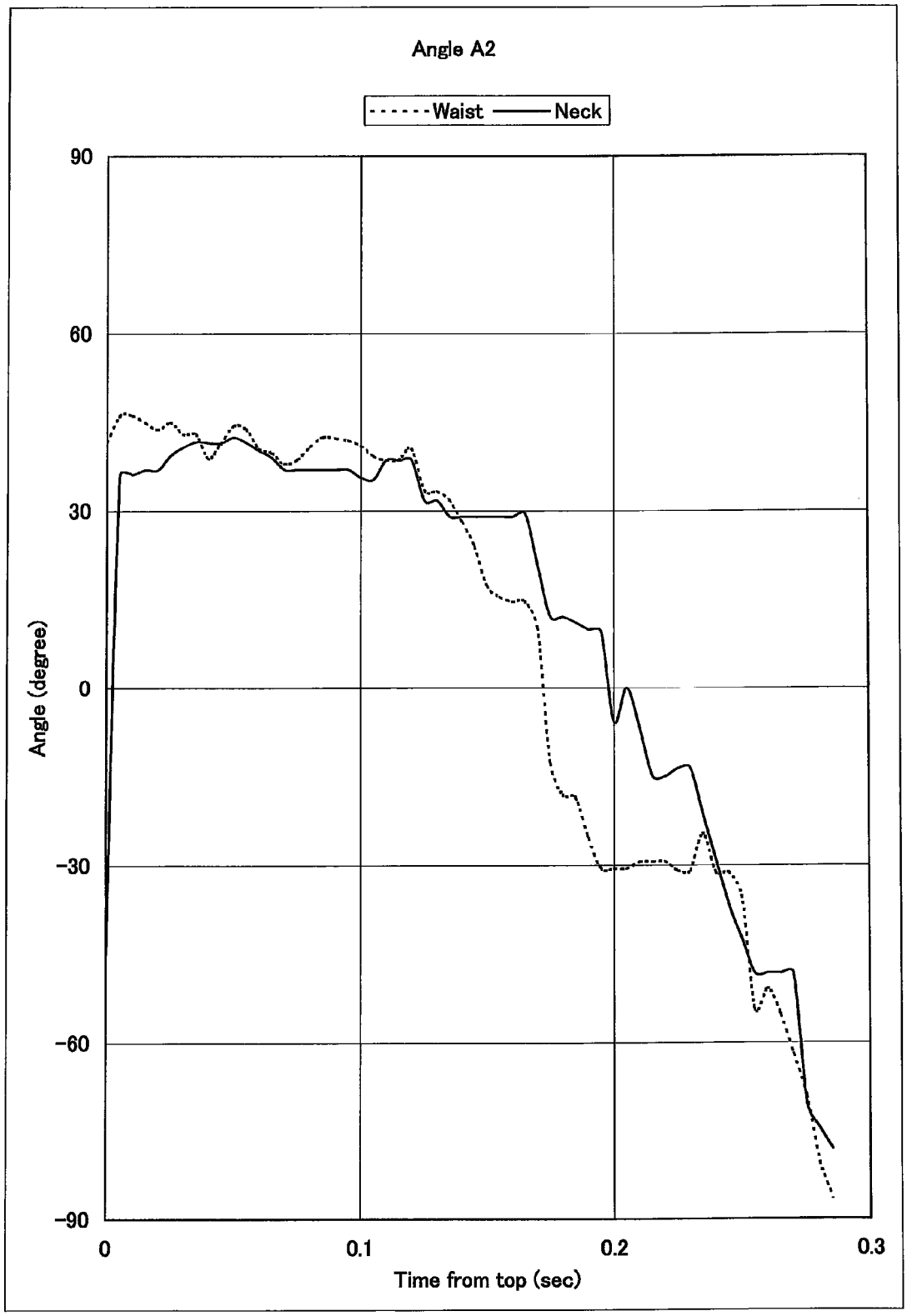
FIG. 37 is a graph showing another example of data analysis.

FIG. 37 is a graph with a horizontal axis showing a time from a top-of-swing and a vertical axis showing an angle A2 (degree) between an x-axis direction and a vector (x, z). The vector (x, z) is the vector sum of acceleration vector in the x-axis direction and acceleration vector in a z-axis direction. The calculating formula of this angle A2 is described above.

In FIG. 37, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this angle A2. The graph line of this angle A2 may be further analyzed. As described above, this angle A2 and this graph line can be analyzed variously.

Figure 38:
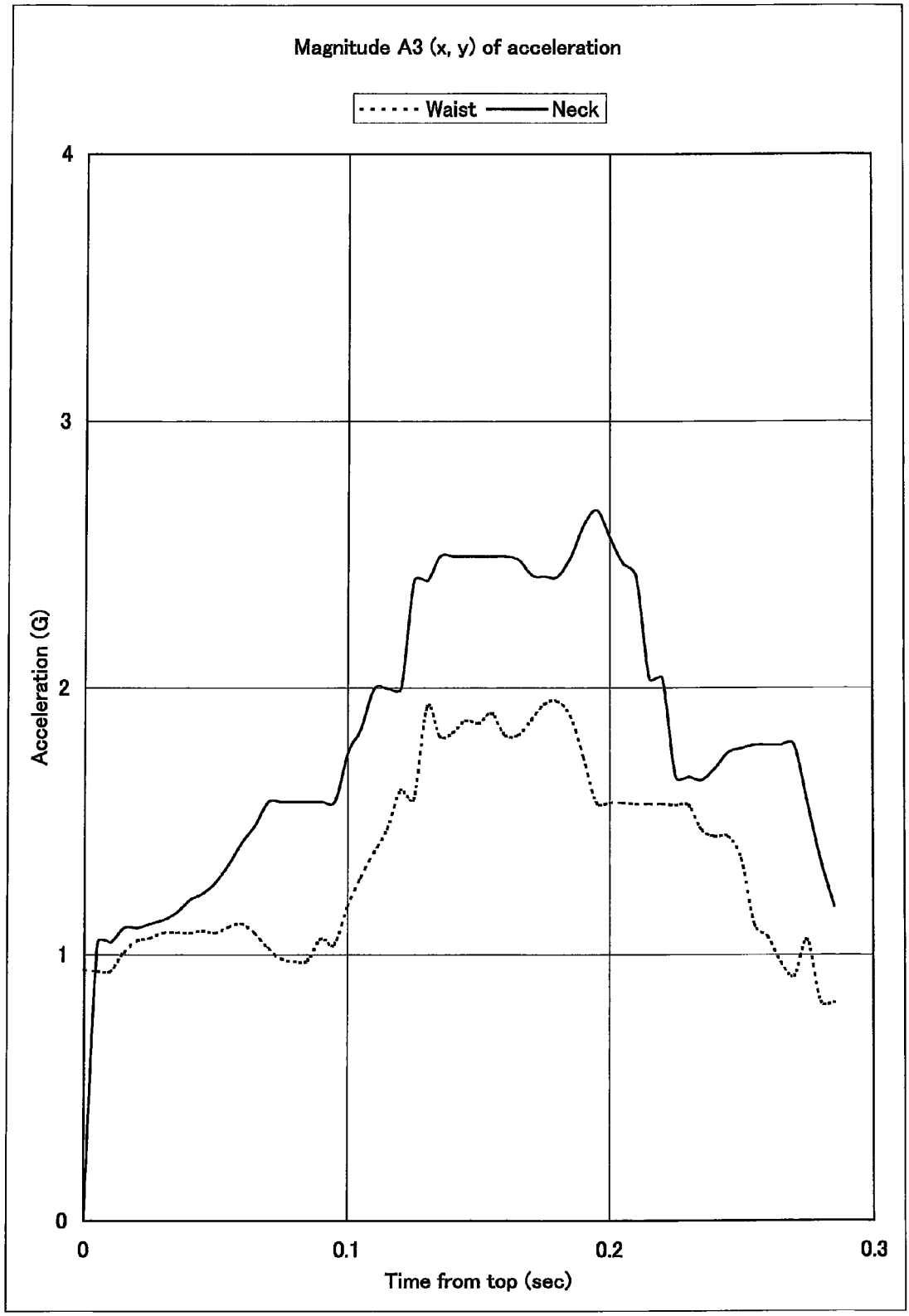
FIG. 38 is a graph showing another example of data analysis.

FIG. 38 is a graph with a horizontal axis showing a time from a top-of-swing and a vertical axis showing the magnitude A3 of the vector (x, y). The calculating formula of this magnitude A3 is described above.

In FIG. 38, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A3. The graph line of this value A3 may be further analyzed. As described above, this value A3 and this graph line can be analyzed variously.

Figure 39:
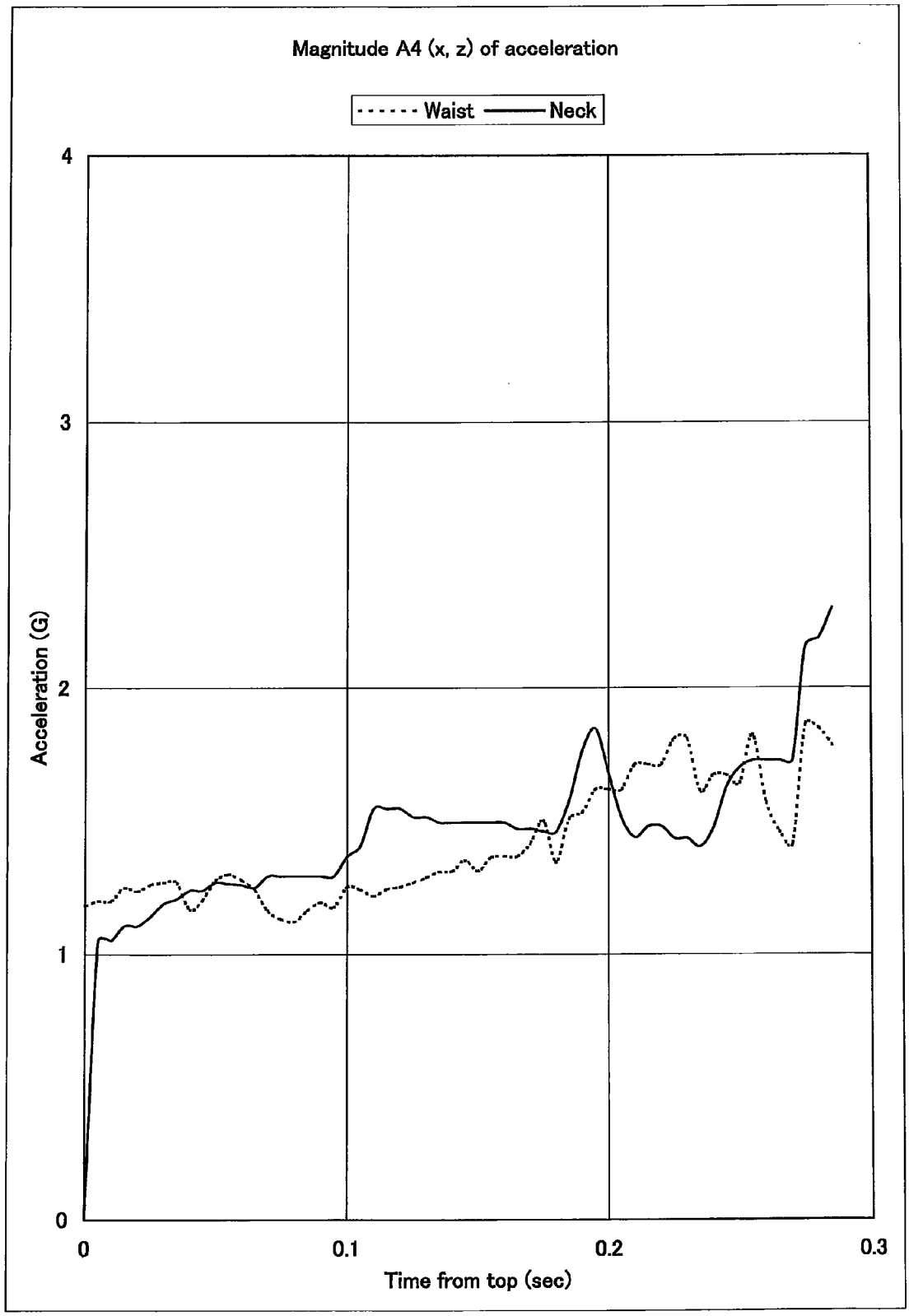
FIG. 39 is a graph showing another example of data analysis.

FIG. 39 is a graph with a horizontal axis showing a time from a top-of-swing and a vertical axis showing the magnitude A4 of the vector (x, z). The calculating formula of this magnitude A4 is described above.

In FIG. 39, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A4. The graph line of this value A4 may be further analyzed. As described above, this value A4 and this graph line can be analyzed variously.

Figure 40:
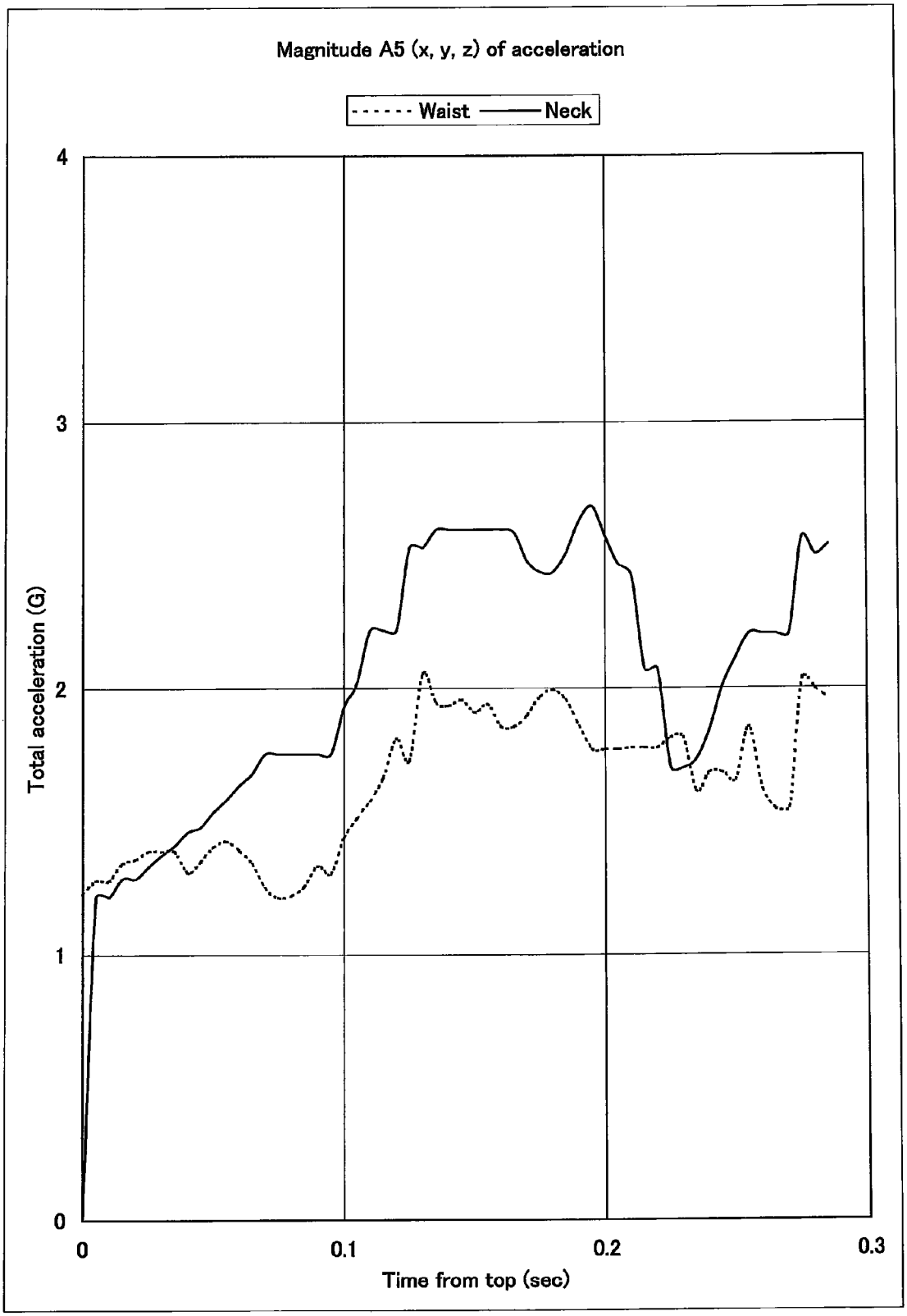
FIG. 40 is a graph showing another example of data analysis.

FIG. 40 is a graph with a horizontal axis showing a time from a top-of-swing and a vertical axis showing the magnitude A5 of the vector (x, y, z). The calculating formula of this magnitude A5 is described above.

In FIG. 40, the broken line shows measured data based on the acceleration measuring device (acceleration measuring device 41 of FIG. 2) attached to a waist. The solid line shows measured data based on the acceleration measuring device (acceleration measuring device 42 of FIG. 2) attached to a neck. In the present invention, for example, the swing is analyzed by this value A5. The graph line of this value A5 may be further analyzed. As described above, this value A5 and this graph line can be analyzed variously.

As exemplified above, the present invention enables the diversified swing analysis.

The present invention can be applied to the analysis of the golf swing. This analysis result can applied to the development of the golf club and golf ball or the like, and the selection of the golf club and/or golf ball suitable for the specific golf player, or the like. This analysis result can be used also at the shop front of the golf shop.

The description hereinabove is merely for an illustrative example, and various modifications can be made in the scope not to depart from the principles of the present invention.

What is claimed is:

1. A golf club selection method comprising steps of:

preparing a radio type acceleration measuring device capable of measuring respective accelerations in three axis directions of an x-axis direction, a y-axis direction, and a z-axis direction; mounting the acceleration measuring device to a golf player's body;

providing a data analysis device for receiving measured data from the acceleration measuring device during a swing through radio communication;

the data analysis device analyzing a golf swing based on the measured data from the acceleration measuring device and providing a swing analysis, and selecting a golf club suitable for the golf player performing the swing based on the measured data of the swing analysis, wherein the swing analysis comprises steps of:

comparing repeatabilities of swings by a same golf player with different golf clubs, and determining a golf club having higher repeatability to be relatively suitable for the golf player; or comparing repeatabilities of swings by a same golf player with a plurality of kinds of golf clubs which are different only in a shaft, and determining a shaft having higher repeatability to be relatively suitable for the golf player, wherein when an acceleration data in the x-axis direction is set to Ax, an acceleration data in the y-axis direction is set to Ay, and an acceleration data in the z-axis direction is set to Az, and the repeatability of determined by (A), (B) or (C) as defined below:

(A) a maximum value and a minimum value in a specific section during the swing are obtained for a value calculated from the acceleration Ax, the acceleration Ay, the acceleration Az, or at least one of the accelerations; and a difference between the maximum value and the minimum value is taken as an indication of the swing analysis, and repeatability of the swing is determined based on the indication of the swing analysis;

(B) a maximum value and a minimum value in a specific section during the swing are obtained for a value calculated from the acceleration Ax, the acceleration Ay, the acceleration Az, or at least one of the accelerations; and a time difference Td1 between a time of the maximum value and a time of the minimum value is taken as an indication of the swing analysis, and repeatability of the swing is determined based on the indication of the swing analysis;

(C) when a same golf player swings a same golf club plural times, a plurality of graph lines are obtained based on data of the plurality of swings; and an area s1 surrounded by the plurality of graph lines is taken as an indication of the swing analysis, and repeatability of the swing is determined based on the indication of the swing analysis.

2. The golf club selection method according to claim 1, wherein the acceleration measuring device is attached to each of two or more portions of the body.

3. The golf club selection method according to claim 2, wherein an attached position of the acceleration measuring device is a head, a neck, a shoulder, a back, a waist or a wrist.

4. The golf club selection method according to claim 1, wherein a trigger signal is generated at a time point during the swing, and the acceleration data is associated with a swing motion in time series based on the trigger signal.

5. The golf club selection method according to claim 4, wherein the time point at which the trigger signal is generated is a top-of-swing or an impact.

6. The golf club selection method according to claim 1, wherein a direction connecting an impact point to a target point and being parallel to a ground is the X-axis direction; a vertical direction is the Y-axis direction; a direction being perpendicular to the X-axis direction and the Y-axis direction is the Z-axis direction; and the acceleration data has a component of the Z-axis direction.

7. The golf club selection method according to claim 1, wherein a weight of the acceleration measuring device is equal to or less than 10 g.

* * * * *